US007780903B2

(12) United States Patent
Topolkaraev et al.

(10) Patent No.: US 7,780,903 B2
(45) Date of Patent: Aug. 24, 2010

(54) METHOD OF MAKING FIBERS AND NONWOVENS WITH IMPROVED PROPERTIES

(75) Inventors: Vasily A. Topolkaraev, Appleton, WI (US); Jayant Chakravarty, Appleton, WI (US); Kevin Christopher Possell, Middleton, WI (US); Hristo Angelov Hristov, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 945 days.

(21) Appl. No.: 11/142,791

(22) Filed: Jun. 1, 2005

(65) Prior Publication Data

US 2006/0273495 A1 Dec. 7, 2006

(51) Int. Cl.

| | |
|---|---|
| ***D01D 5/088*** | (2006.01) |
| ***D01D 5/098*** | (2006.01) |
| ***D01D 5/12*** | (2006.01) |
| ***D01F 1/10*** | (2006.01) |
| ***D04H 3/02*** | (2006.01) |

(52) U.S. Cl. ..... 264/555; 264/103; 264/210.6; 264/210.8; 264/211.14

(58) Field of Classification Search ..... 264/103, 264/210.6, 210.8, 211.14, 555
See application file for complete search history.

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,542,615 | A | 11/1970 | Dobo et al. |
| 3,692,618 | A | 9/1972 | Dorschner et al. |
| 3,802,817 | A | 4/1974 | Matsuki et al. |
| 3,849,241 | A | 11/1974 | Butin et al. |
| 3,936,253 | A | 2/1976 | Fisher et al. |
| 4,045,534 | A | 8/1977 | Fisher et al. |

(Continued)

FOREIGN PATENT DOCUMENTS

| | | | |
|---|---|---|---|
| JP | 09-095848 | A | 4/1997 |

(Continued)

OTHER PUBLICATIONS

American Society for Testing Materials (ASTM) Designation: D1238-95 (aka D1238-E), "Standard Test Method for Flow Rates of Thermoplastics by Extrusion Plastometer," pp. 273-281, published Jan. 1996.

(Continued)

*Primary Examiner*—Leo B Tentoni
(74) *Attorney, Agent, or Firm*—Paul Yee; Vincent Kung

(57) ABSTRACT

The present invention can provide a distinctive method and process for making polymer fibers (62) and nonwoven fabric webs (60). The method can include providing a fiber material that exhibits a low crystallization rate. In a particular aspect, the fiber material can be subjected to an anneal-quench at an anneal-quench temperature that approximates a prime-temperature at which the polymer material most rapidly crystallizes. In another aspect, the fiber material can be subjected to a fiber-draw at a selected fiber-draw temperature, and in a further aspect, the fiber-draw temperature can be configured to approximate the prime-temperature of the polymer material. In still other aspects, the fiber material can be subjected to a relatively small amount of fiber-draw, and the fiber-draw can be provided at a relatively low fiber-draw speed.

20 Claims, 20 Drawing Sheets

U.S. PATENT DOCUMENTS

| | | | | |
|---|---|---|---|---|
| 4,070,432 | A | 1/1978 | Tamaddon | |
| 4,340,563 | A | 7/1982 | Appel et al. | |
| 5,082,899 | A | 1/1992 | Sawyer et al. | |
| 5,180,765 | A | 1/1993 | Sinclair | |
| 5,707,468 | A | 1/1998 | Arnold et al. | |
| 5,753,736 | A | 5/1998 | Bhat et al. | |
| 5,811,045 | A * | 9/1998 | Pike | 264/210.6 X |
| 6,121,410 | A | 9/2000 | Gruber et al. | |
| 6,159,406 | A * | 12/2000 | Shelby et al. | 264/211.12 |
| 6,355,772 | B1 | 3/2002 | Gruber et al. | |
| 6,506,873 | B1 | 1/2003 | Ryan et al. | |
| 6,509,092 | B1 | 1/2003 | Dugan | |
| 6,607,996 | B1 | 8/2003 | Matsunaga et al. | |
| 6,787,493 | B1 | 9/2004 | Nagaoka et al. | |
| 2001/0001689 | A1 * | 5/2001 | Tang et al. | 428/371 |
| 2003/0082360 | A1 | 5/2003 | O'Donnell et al. | |
| 2006/0276092 | A1 | 12/2006 | Topolkaraev et al. | |

FOREIGN PATENT DOCUMENTS

| | | | |
|---|---|---|---|
| JP | 2003-293237 | A | 10/2003 |
| WO | WO 98/50611 | A1 | 11/1998 |

OTHER PUBLICATIONS

American Society for Testing Materials (ASTM) Designation: D5034-95, "Breaking Strength and Elongation of Textile Fabrics (Grab Test)," pp. 1-8, published Jul. 1995.

American Society for Testing Materials (ASTM) Designation: D5104-96, "Standard Test Method for Shrinkage of Textile Fibers (Single-Fiber Test)," pp. 1-4, published Jan. 1997.

Chisholm, B.J. and J.G. Zimmer, "Isothermal Crystallization Kinetics of Commercially Important Polyalkylene Terephthalates," *Journal of Applied Polymer Science*, vol. 76, No. 8, May 23, 2000, pp. 1296-1307.

Cooper-White et al., "Rheological Properties of Poly(lactides). Effect of Molecular Weight and Temperature on the Viscoelasticity of Poly(*l*-lactic acid)," *Journal of Polymer Science*, vol. 37, Mar. 1999, pp. 1803-1814.

Fatou, J.G., "Cryztallization Kinetics," *Encyclopedia of Polymer Science and Engineering*, Supplement Volume, John Wiley & Sons, 1989, pp. 231-296.

Garlotta, Donald, "A Literature Review of Poly(Lactic Acid)," *Journal of Polymers and the Environment*, vol. 9, No. 2, Apr. 2001, pp. 63-84.

Lawrence, K.D. et al., "An Improved Device for the Formation of Superfine, Thermoplastic Fibers," *NRL Report 5265*, U.S. Naval Research Laboratory, Washington, D.C., Feb. 11, 1959, pp. 1-7.

Lin, C.C., "The Rate of Crystallization of Poly(Ethylene Terephthalate) by Differential Scanning Calorimetry," *Polymer Engineering and Science*, vol. 23, No. 3, Feb. 1983, pp. 113-116.

Tsuji, Hideto, "Polylactides," *Biopolymers—vol. 4—Polyesters III: Applications and Commercial Products*, Wiley-VCH, 2002, pp. 129-177.

Wente, V.A. et al., "Manufacture of Superfine Organic Fibers," *NRL Report 4364*, U.S. Naval Research Laboratory, Washington, D.C., May 25, 1954, pp. 1-15.

Nijenhuis, A.J., "Highly Crystalline As-Polymerized Poly(L-lactide)," Polymer Bulletin, vol. 26, Jul. 1991, pp. 71-77.

* cited by examiner

Table 1

| Quench temp. = 12 °C<br>FDU temp.= 12 °C | | | Crystallinity | | | | | | | Individual Fiber Characteristics | | | | | |
|---|---|---|---|---|---|---|---|---|---|---|---|---|---|---|---|
| FDU pres-sure | Visual web width before HAK | Visual web width after HAK | % shrink-age | Cold Crystalli -zation Enthalpy | Melt peak Enthalpy | % crystalli-zation by DSC | Width at Half Pk height | % crystal-linity by XRD | Crystal Size | Tenacity | Fiber Size | % Strain at Break | Peak Load gf | Fiber Velo-city | Draw Down Ratio |
| KPa | mm | mm | % | j/g | j/g | % | Deg C | % | nm | g/denier | micron | % | gf | m/min | unit less |
| 21 | 330 | 184 | 44.2 | 20.75 | 50.29 | 31.5 | 6.3 | 0.0 | | 3.43 | 17.2 | 145.6 | 8.68 | 1893 | 1051 |
| 28 | 330 | 165 | 50.0 | 23.3 | 49.84 | 28.3 | 6.2 | 0.0 | | 3.05 | 17.515 | 102.3 | 8.16 | 1825 | 1014 |
| 35 | 330 | 216 | 34.5 | 15.49 | 55.48 | 42.7 | 6.5 | 2.0 | | 3.464 | 15.28 | 75.8 | 7.04 | 2399 | 1332 |
| 42 | 330 | 216 | 34.5 | 20.3 | 54.6 | 36.6 | 6.4 | 5.0 | 5.7 | 3.535 | 14.885 | 78.97 | 6.71 | 2527 | 1404 |
| 56 | 330 | 280 | 15.2 | 13.1 | 58.34 | 48.3 | 9.2 | 11.0 | 7.6 | 3.16 | 15.285 | 72.27 | 6.51 | 2397 | 1331 |
| 70 | 330 | 292 | 11.5 | 10.87 | 59.44 | 51.8 | 9.9 | 19.0 | 8.9 | 3.397 | 13.09 | 50.35 | 4.92 | 3268 | 1815 |

FIG. 3

Table 2

| Anneal quench temp. = 100 °C<br>FDU temp. = 12 °C | | | | Crystallinity | | | | | | Individual Fiber Characteristics | | | | | |
|---|---|---|---|---|---|---|---|---|---|---|---|---|---|---|---|
| FDU pres - sure | Visual web width before HAK | Visual web width after HAK | % shrink -age | Cold Crystalli- zation Enthalpy | Melt peak Enthalpy | % crystalli- zation by DSC | Width at Half Pk height | % crystal- linity by XRD | Crystal Size | Tena- city | Fiber Size | % Strain At Break | Peak Load gf | Fiber Velo- city | Draw Down Ratio |
| KPa | mm | mm | % | j/g | j/g | % | Deg C | % | nm | g/deni er | micron | % | gf | m/min | Unit less |
| **21** | 330 | 152 | 53.9 | 23.17 | 47.63 | 26.1 | 6.7 | 0.0 | | 2.51 | 21.4 | 175.6 | 9.89 | 1223 | 679 |
| **28** | 330 | 152 | 53.9 | 21.13 | 52.17 | 33.1 | 6.3 | 0.0 | | 2.336 | 20.725 | 126 | 8.854 | 1304 | 724 |
| **35** | 330 | 178 | 46.1 | 22.08 | 54.1 | 34.2 | 6.7 | 2.0 | | 2.537 | 18.23 | 90.5 | 7.45 | 1685 | 936 |
| **42** | 330 | 241 | 27.0 | 11.97 | 55.75 | 46.7 | 7.6 | 8.0 | 5.5 | 2.694 | 17.65 | 83.3 | 7.45 | 1798 | 998 |
| **56** | 330 | 254 | 23.0 | 15.38 | 59.95 | 47.6 | 9.6 | 18.0 | 7.2 | 2.612 | 15.99 | 63.5 | 5.92 | 2190 | 1217 |
| **70** | 330 | 292 | 11.5 | 10.55 | 58.53 | 51.2 | 10.7 | 22.7 | 8.7 | 3.014 | 14.52 | 53.5 | 5.61 | 2656 | 1475 |
| **80** | 330 | 305 | 7.6 | 9.062 | 60.43 | 54.8 | 11.2 | 23.0 | 9.3 | 3.284 | 13.8 | 45.95 | 5.426 | 2941 | 1633 |

FIG. 4

Table 3

| | | | Spunbond Grab Tensile test | | | | | | | Spunbond Acquisition Test (Lister) | | | | | | |
|---|---|---|---|---|---|---|---|---|---|---|---|---|---|---|---|---|
| Quench Temp | FDU temper-ature | FDU pres-sure | Liner gsm | Fiber Size | CD Grab Peak Load | MD Grab Peak Load | CD / MD | Elmen-dorf | RAT (Abra-sion) | Lister 1st Acqui-sition Time-Face | Lister 2nd Acqui-sition Time-Face | Lister 3rd Acqui-sition Time-Face | Lister 4th Acqui-sition Time-Face | Lister 5th Acqui-si tion Time-Face | Liquid reten-tion After Test | Runoff-Face |
| °C | °C | KPa | gsm | micron | kg | kg | | Spec=200 | Spec=5 | sec | sec | sec | sec | sec | g | g |
| Example 3 (Spunbond from Biomer L9000 resin ) | | | | | | | | | | | | | | | | |
| 100 | 12 | 56 | 22.6 | 16.49 | 1.97 | 3.97 | 0.5 | 192 | 4.25 | 8.11 | 8.60 | 11.23 | 8.51 | 9.38 | 0.03 | 14.97 |
| 100 | 12 | 70 | 20.3 | 14.10 | 1.76 | 3.38 | 0.52 | 228 | 5 | 7.63 | 6.77 | 7.68 | 7.65 | 7.15 | 0.01 | 11.16 |
| 100 | 12 | 70 | 23.7 | 16.21 | 2.07 | 3.85 | 0.54 | 212 | 5 | 8.75 | 10.96 | 9.03 | 8.22 | 11.41 | 0.02 | 11.82 |
| 100 | 12 | 80 | 24.6 | 14.20 | 2.14 | 3.86 | 0.55 | 193 | 4.5 | 10.16 | 9.65 | 10.43 | 9.13 | 10.66 | 0.03 | 22.98 |
| Example 5 (Spunbond from Biomer 95% L9000 & 5% L1000 dry blend resin ) | | | | | | | | | | | | | | | | |
| 100 | 12 | 56 | 25.5 | 17.21 | 2.22 | 4.08 | 0.54 | 103 | 4.75 | 7.06 | 7.47 | 7.73 | 8.01 | 12.45 | 0.02 | 15.85 |
| 100 | 12 | 70 | 24.7 | 16.01 | 2.29 | 4.15 | 0.55 | 162 | 4 | 9.29 | 9.91 | 8.73 | 7.24 | 9.63 | 0.03 | 19.69 |
| 100 | 12 | 80 | 27.5 | 15.47 | 2.1 | 5.16 | 0.41 | 227 | 3.75 | 14.29 | 19.07 | 19.95 | 21.50 | 11.60 | 0.05 | 34.79 |
| Polypropylene Spunbond manufactured in same facility (Exxon 3155 resin) | | | | | | | | | | | | | | | | |
| 12 | 12 | 28 | 19.3 | 21.70 | 3.36 | 3.63 | 0.93 | | | 33.89 | 15.22 | 22.46 | 27.39 | 36.82 | 0.08 | 41.31 |
| 12 | 12 | 28 | 28.5 | 20.50 | 4.65 | 6.24 | 0.75 | | | 30.25 | 34.00 | 25.00 | 27.30 | 49.95 | 0.02 | 49.24 |
| Commercial Unitika 30 gsm (0.9 osy) PLA spunbond | | | | | | | | | | | | | | | | |
| | | | 30 | 19.54 | 2.58 | 7.49 | 0.34 | | | | | Liner not tested as untreated liner not available | | | | |

FIG. 5

Table 4

| | | | | Crystallinity | | | | | | Individual Fiber Characteristics | | | | | |
|---|---|---|---|---|---|---|---|---|---|---|---|---|---|---|---|
| FDU press-ure | Visual web width before HAK | Visual web width after HAK | % shrink -age | Cold Crystalli -zation Enthalpy | Melt peak Enthalpy | % crystalli-zation by DSC | Width at Half Pk height | % crystal-linity by XRD | Crystal Size | Tenacity | Fiber Size | % Strain at Break | Peak Load gf | Fiber Velo-city | Draw Down Ratio |
| KPa | mm | mm | % | J/g | J/g | % | Deg C | % | nm | g/denier | micron | % | gf | m/min | Unit less |
| 21 | 330 | 210 | 36.4 | 26.89 | 48.72 | 23.3 | 5.9 | 0.0 | | 2.606 | 19.25 | 154 | 8.2 | 1511 | 839 |
| 28 | 330 | 165 | 50.0 | 27.85 | 53.94 | 27.8 | 5.4 | 0.0 | | 2.856 | 18.13 | 134 | 8.1 | 1704 | 946 |
| 35 | 330 | 140 | 57.6 | 24.84 | 57.41 | 34.8 | 5.2 | 0.0 | | 1.18 | 15.17 | 90 | 6.828 | 2433 | 1352 |
| 42 | 330 | 159 | 51.8 | 21.9 | 60.27 | 40.9 | 4.7 | 2.0 | | 0.793 | 15.36 | 83 | 6.23 | 2374 | 1318 |
| 56 | 330 | 235 | 28.8 | 16.58 | 56.54 | 42.6 | 6.1 | 11.0 | 6.0 | 4.1 | 12.67 | 65.2 | 5.62 | 3488 | 1938 |
| 70 | 330 | 254 | 23.0 | 15.13 | 60.68 | 48.6 | 6.6 | 14.0 | 8.0 | 3.425 | 13.05 | 60.23 | 5.05 | 3288 | 1826 |
| 80 | 330 | 267 | 19.1 | 16.25 | 64.97 | 52.0 | 8.0 | 19.0 | 8.0 | 3.517 | 12.39 | 47.54 | 4.6 | 3648 | 2026 |

FIG. 6

Table 5

| Trial Site Data | | | | | | Crystallinity | | | | | | | Individual Fiber Characteristics | | | | |
|---|---|---|---|---|---|---|---|---|---|---|---|---|---|---|---|---|---|
| Quench Temp | FDU temp | FDU pres-sure | Visual web width before HAK | Visual web width after HAK | % shrink-age | Cold Crystalli-zation enthalpy | Melt peak enthalpy | % crystalli-zation by DSC | Width at Half Pk height | % crystal-linity by XRD | Crys-tal Size | Tena-city | Fiber Size | % Strain at Break | Peak Load gf | Fiber Velo-city | Draw Down Ratio |
| °C | °C | KPa | mm | mm | % | J/g | J/g | % | Deg C | % | nm | g per denier | micron | % | gf | m/ min | Unit Less |
| EXAMPLE 6 | | | | | | | | | | | | | | | | | |
| 12 | 12 | 14 | 432 | 292 | 32.4 | 28.81 | 51.61 | 24.3 | 6.7 | 0.0 | | 1.807 | 22.02 | 180.9 | 7.39 | 861 | 641 |
| 12 | 12 | 21 | 432 | 280 | 35.2 | | | | | | | | | | | | |
| 12 | 12 | 28 | 432 | 292 | 32.4 | 19.36 | 51.66 | 34.4 | 6.4 | 0.0 | | 2.708 | 15.116 | 94.1 | 5.439 | 1827 | 1361 |
| 12 | 12 | 35 | 432 | 305 | 29.4 | | | | | | | | | | | | |
| 12 | 12 | 42 | 432 | 343 | 20.6 | 17.4 | 54.49 | 39.5 | 6.7 | 3.0 | | 2.418 | 14.628 | 53.4 | 4.63 | 1951 | 1454 |
| 12 | 12 | 49 | 432 | 368 | 14.8 | 15.75 | 55.91 | 42.7 | 8.3 | 7.0 | 7.5 | 2.965 | 12.37 | 64.88 | 3.97 | 2728 | 2033 |
| EXAMPLE 7 | | | | | | | | | | | | | | | | | |
| 100 | 12 | 14 | 432 | 295 | 31.7 | 25.77 | 50.27 | 26.1 | 7.0 | 0.0 | | 2.737 | 19.537 | 165 | 8.78 | 1094 | 815 |
| 100 | 12 | 21 | 432 | 282 | 34.7 | | | | | | | | | | | | |
| 100 | 12 | 28 | 432 | 254 | 41.2 | 17.86 | 52.11 | 36.4 | 6.2 | 0.0 | | 1.946 | 19.655 | 116.5 | 6.6 | 1081 | 805 |
| 100 | 12 | 35 | 432 | 292 | 32.4 | | | | | | | | | | | | |
| 100 | 12 | 42 | 432 | 343 | 20.6 | 19.44 | 55.85 | 38.7 | 6.2 | 4.0 | | 2.838 | 15.165 | 58.3 | 5.7 | 1815 | 1352 |
| 100 | 12 | 49 | 432 | 356 | 17.6 | 15.16 | 56.98 | 44.5 | 6.9 | 8.0 | 6.6 | 2.122 | 15.455 | 53.76 | 4.43 | 1748 | 1302 |

FIG. 7

Table 6

| Trial Site Data | | | Crystallinity | | | | | | | Individual Fiber Characteristics | | | | |
|---|---|---|---|---|---|---|---|---|---|---|---|---|---|---|
| Quench Temp | FDU temp. | FDU pressure | Cold Crystallization Enthalpy | Melt peak enthalpy | % crystallization by DSC | Width at Half Pk height | % crystallinity by XRD | Crystal Size | Tenacity | Fiber Size | % Strain At Break | Peak Load gf | Fiber Velocity | Draw Down Ratio |
| °C | °C | KPa | J/g | J/g | % | Deg C | % | nm | g/denier | micron | % | gf | m/min | Unitless |
| Example 8 | | | | | | | | | | | | | | |
| 12 | 12 | 28 | 22.86 | 43.59 | 22.1 | 6.4 | 0.0 | | 3.27 | 22.07 | 107.8 | 7.475 | 1150 | 639 |
| 12 | 12 | 42 | 22.17 | 47.9 | 27.5 | 6.6 | 2.0 | | 2.803 | 17.34 | 84.4 | 6.013 | 1862 | 1034 |
| 12 | 12 | 56 | 12.48 | 46.98 | 36.8 | 7.5 | 12.0 | 9.3 | 2.799 | 15.45 | 58.6 | 6.45 | 2346 | 1303 |
| 12 | 12 | 70 | 8.82 | 49.29 | 43.2 | 9.5 | 20.0 | 9.8 | 3.061 | 15.78 | 57.2 | 7.1 | 2249 | 1249 |
| 12 | 12 | 84 | 6.314 | 49.49 | 46.1 | 8.7 | 21.0 | 9.5 | 2.448 | 13.44 | 43.8 | 4.92 | 3100 | 1722 |
| | | | | | | | | | | | | | | |
| Example 9 | | | | | | | | | | | | | | |
| 100 | 100 | 28 | 21.61 | 41.69 | 21.4 | 6.7 | 0.0 | | 3.574 | 20.25 | 96.54 | 7.453 | 1366 | 759 |
| 100 | 100 | 42 | 13.49 | 47.38 | 36.2 | 7.2 | 9.0 | 5.8 | 3.239 | 17.41 | 71.4 | 6.795 | 1848 | 1026 |
| 100 | 100 | 56 | 9.86 | 48.98 | 41.8 | 8.0 | 17.0 | 7.5 | 2.468 | 15.65 | 52.3 | 4.913 | 2286 | 1270 |
| 100 | 100 | 70 | 5.459 | 55.42 | 53.3 | 11.2 | 22.0 | 9.2 | 2.456 | 14.69 | 43.82 | 4.937 | 2595 | 1441 |
| 100 | 100 | 84 | 3.104 | 53.42 | 53.7 | 11.9 | 23.4 | 10.0 | 2.71 | 13.12 | 45.84 | 4.609 | 3253 | 1807 |
| Example 11 (commercial UNITIKA PLA SB 30 gsm) | | | | | | | | | | | | | | |
| | | | 0.548 | 52.05 | 55.0 | 10.8 | | | | 19.54 | | | | |

FIG. 8

SB = Spunbond 1 psi~ 7 kPa

Table 7

DSC Peak Deconvolution: Progressive linear base; tolerance 1%; Savitsky-Golay Smoothing;Minimum $R^2$=0.995
Gaussian Peak Deconvolution using Peakfit 4.11

| Quench Temp | Draw Temp | Draw Pressure | ghm | Pack Holes Per inch | peak1 area | Paek1 Location | Peak2 Area | Peak2 Location | Total Area | Ratio Peak1/peak2 | Peak1 area % | Peak2 Area% |
|---|---|---|---|---|---|---|---|---|---|---|---|---|
| deg F | deg F | psi | | | | deg C | | deg C | | | % | % |
| | | | | | | | | | | | | |
| 53 | 53 | 3 | 0.55 | 50 | 12.34 | 163.7 | 106.8 | 169.6 | 119.14 | **11.6** | 10.4 | 89.6 |
| 53 | 53 | 4 | 0.55 | 50 | 16.25 | 163.7 | 98.2 | 169.5 | 114.45 | **16.5** | 14.2 | 85.8 |
| 53 | 53 | 5 | 0.55 | 50 | 21.07 | 164.3 | 89.13 | 170.1 | 110.21 | **23.6** | 19.1 | 80.9 |
| 53 | 53 | 6 | 0.55 | 50 | 24.15 | 164.0 | 85.98 | 169.5 | 110.13 | **28.1** | 21.9 | 78.1 |
| 53 | 53 | 8 | 0.55 | 50 | 35.05 | 164.6 | 89.05 | 169.9 | 124.1 | **39.4** | 28.2 | 71.8 |
| 53 | 53 | 10 | 0.55 | 50 | 38.56 | 164.2 | 86 | 169.5 | 124.56 | **44.8** | 31.0 | 69.1 |
| | | | | | | | | | | | | |
| | | | | | | | | | | | | |
| 212 | 53 | 3 | 0.55 | 50 | 7.86 | 163.4 | 86.49 | 169.2 | 94.36 | **9.1** | 8.3 | 91.7 |
| 212 | 53 | 4 | 0.55 | 50 | 12.6 | 163.2 | 99.96 | 169.1 | 112.55 | **12.6** | 11.2 | 88.8 |
| 212 | 53 | 5 | 0.55 | 50 | 17.16 | 163.8 | 105.07 | 169.7 | 122.23 | **16.3** | 14.0 | 86.0 |
| 212 | 53 | 6 | 0.55 | 50 | 23.22 | 162.9 | 98.17 | 168.5 | 121.39 | **23.7** | 19.1 | 80.9 |
| 212 | 53 | 8 | 0.55 | 50 | 38.46 | 163.5 | 88 | 168.8 | 126.55 | **43.7** | 30.5 | 69.5 |
| 212 | 53 | 10 | 0.55 | 50 | 51.5 | 164.4 | 83.66 | 170.9 | 135.16 | **61.6** | 38.1 | 61.9 |
| 212 | 53 | 11.5 | 0.55 | 50 | 50.96 | 164.1 | 82.94 | 170.2 | 133.9 | **61.4** | 38.1 | 62.0 |
| | | | | | | | | | | | | |
| 53 | 53 | 4 | 0.55 | 100 | 9.27 | 163.8 | 69.81 | 169.6 | 79.09 | **13.3** | 11.7 | 88.3 |
| 53 | 53 | 6 | 0.55 | 100 | 11.93 | 163.4 | 77.31 | 169.2 | 89.25 | **15.4** | 13.4 | 86.6 |
| 53 | 53 | 8 | 0.55 | 100 | 11.07 | 163.7 | 72.09 | 169.2 | 83.17 | **15.4** | 13.3 | 86.7 |
| 53 | 53 | 10 | 0.55 | 100 | 21.37 | 164.7 | 67.41 | 169.5 | 88.8 | **31.7** | 21.1 | 75.9 |
| 53 | 53 | 12 | 0.55 | 100 | 17.08 | 163.3 | 49.96 | 167.6 | 67.04 | **34.2** | 25.5 | 74.5 |
| | | | | | | | | | | | | |
| 212 | 212 | 4 | 0.55 | 100 | 8.21 | 163.9 | 75.98 | 170.0 | 84.19 | **10.8** | 9.8 | 90.3 |
| 212 | 212 | 6 | 0.55 | 100 | 14.46 | 163.1 | 74.32 | 169.0 | 88.8 | **19.5** | 16.3 | 83.7 |
| 212 | 212 | 8 | 0.55 | 100 | 19.33 | 163.9 | 73.11 | 169.4 | 92.45 | **26.4** | 20.9 | 79.1 |
| 212 | 212 | 10 | 0.55 | 100 | 43.49 | 164.6 | 64.52 | 170.4 | 108.02 | **67.4** | 40.3 | 59.7 |
| 212 | 212 | 12 | 0.55 | 100 | 42.68 | 163.8 | 54.53 | 169.8 | 97.21 | **78.3** | 43.9 | 56.1 |

FIG. 17

METHOD OF MAKING FIBERS AND NONWOVENS WITH IMPROVED PROPERTIES

FIELD OF THE INVENTION

The present invention relates to fibers and nonwoven fabric webs, and methods for making the fibers and nonwoven fabric webs. The fibers and nonwoven webs can be used on or in various personal care articles, as well as other articles, such as protective outerwear and protective covers.

BACKGROUND OF THE INVENTION

The processing of particular types of fibers and particular types of nonwoven fabrics using conventional fiber spinning technology has been a significant challenge. Particular types of fiber materials have exhibited a very low level of crystallinity. Particular types of fiber materials have also tended to shrink dramatically when heated above the glass transition temperature of the fiber material. This shrinkage has led to a poor dimensional stability of these types of fibers and the nonwoven fabric webs formed with the fibers. A large amount of physical drawing and stretching of the fibers at very high speeds has been employed to help reduce the fiber instability. Such drawing operations, however, have significantly complicated the formation processes typically employed for producing nonwoven fabrics, and have not allowed an economical use of ordinary, lower cost processes and equipment. The large amount of physical drawing has resulted in high fiber velocities and a biased fiber orientation along a machine-direction of the production process. The biased fiber orientation has excessively compromised a desired orientation in which the fiber orientation is highly randomized with regard to the machine-direction and cross-direction of the fabric web. The biased, machine-direction orientation of the fibers has caused a poor balance of the fabric tensile properties along the machine-direction and cross-direction of the nonwoven fabric. As a result, there has been a continuing need for improved forming techniques that can more efficiently produce fibers and nonwoven fabrics having desired properties.

BRIEF DESCRIPTION OF THE INVENTION

The present invention can provide a distinctive method and process for making polymer fibers and nonwoven fabric webs. The method can include providing a polymer material that exhibits a slow crystallization rate. In a particular aspect, the polymer material can be subjected to an anneal-quench at an anneal-quench temperature that approximates a prime-temperature at which the polymer material most rapidly crystallizes. In another aspect, the polymer material can be subjected to a fiber-draw at a selected fiber-draw temperature, and in a further aspect the fiber-draw temperature can be configured to approximate the prime-temperature of the polymer material. In further aspects, the polymer material can be subjected to relatively small amounts of fiber-draw, and the fiber-draw can be provided at relatively low fiber-draw speeds and relatively low fiber draw down ratios.

By incorporating its various aspects and features, the method of the invention can produce polymer fibers and nonwoven fabric webs having improved properties and improved dimensional stability. The method of the invention can form polymer fibers and nonwoven fabrics in which the polymer fibers exhibit enhanced crystallinity, reduced shrinkage, improved tenacity and improved wettability. The nonwoven fabrics can have improved web formation, and a more random orientation of the fibers. Additionally, the nonwoven fabrics can be produced with less complicated equipment, and can better accommodate desired thermal processing operations, such as thermal bonding.

BRIEF DESCRIPTION OF THE DRAWINGS

The invention will be better understood by reference to the following description of the invention taken in conjunction with the accompanying drawings, wherein:

FIG. 3 shows a data table pertaining to fibers processed at a low quench temperature.

FIG. 4 shows a data table pertaining to fibers processed at a heated anneal-quench temperature.

FIG. 5 shows a table which includes tensile test data and absorbency test data pertaining to examples disclosed herein.

FIG. 6 shows a data table pertaining to fibers processed at different fiber-drawing pressures.

FIG. 7 shows a data table pertaining to fibers processed at cold quench or heated quench temperatures when drawn at different fiber-drawing pressures.

FIG. 8 shows a data table pertaining to fibers processed with a combination of cold quench and cold fiber-draw; and fibers processed with a combination of heated anneal-quench and heated fiber-draw.

FIG. 17 shows a tabulation of representative, peak deconvolution data from a DSC melt endotherm for fibers that were obtained while employing various quench temperatures, fiber-draw temperatures, and fiber-draw pressure settings.

DETAILED DESCRIPTION OF THE INVENTION

Figure 1:
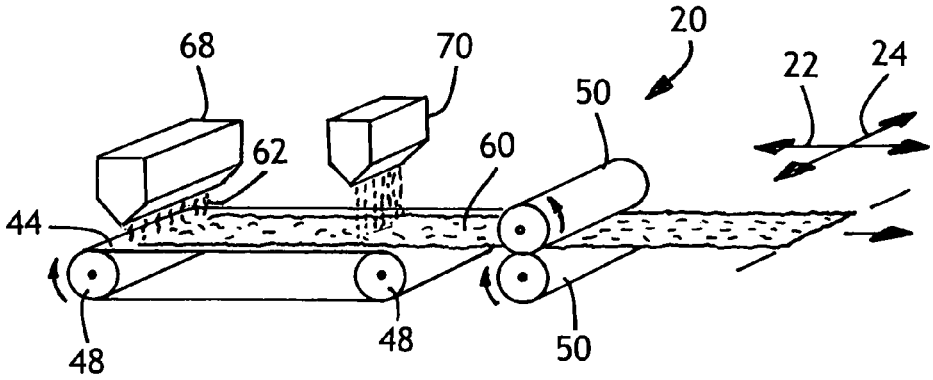
FIG. 1 schematically illustrates a representative method of manufacturing fibers and nonwoven fabric webs in accordance with the invention.

As used in the present disclosure, the term "personal care product" means infant diapers, children's training pants, swimwear, absorbent underpants, adult incontinence products, and feminine hygiene products, such as feminine care pads, napkins and pantiliners. It should be recognized that the inventive material may be incorporated in any of the previously listed personal care products as a sheet or layer component. For instance, such material may be utilized to make a topsheet layer, an intermediate layer, a facing layer, an outercover layer, a stratum of a layered composite or the like, as well as combinations thereof.

As used herein the term "protective outerwear" means garments used for protection in the workplace, such as surgical gowns, hospital gowns, cover gowns, laboratory coats, masks, and protective coveralls.

As used herein, the terms "protective cover" and "protective outercover" mean covers that are used to protect objects such as for example car, boat and barbeque grill covers, as well as agricultural fabrics.

As used herein, the terms "polymer and polymeric" when used without descriptive modifiers, generally include but are not limited to, homopolymers, copolymers, such as for example, block, graft, random and alternating copolymers, terpolymers, etc. and blends and modifications thereof. Furthermore, unless otherwise specifically limited, the term "polymer" includes all possible spatial configurations of the molecule. These configurations include, but are not limited to isotactic, syndiotactic and random symmetries.

As used herein, the terms "machine-direction" (MD) means the direction along the length of a fabric in the direction in which it is produced. The terms "cross-machine direction," "cross-directional," (CD) mean the direction across the width of fabric, i.e. a direction generally perpendicular to the MD.

As used herein, the term "nonwoven web" means a polymeric web having a structure of individual fibers or threads which are interlaid, but not in an identifiable, repeating manner. Nonwoven webs have been, in the past, formed by a variety of processes such as, for example, meltblowing processes, spunbonding processes, hydroentangling, air-laid and bonded carded web processes.

As used herein, the term "bonded carded webs" refers to webs that are made from staple fibers which are usually purchased in bales. The bales are placed in a fiberizing unit/picker which separates the fibers. Next, the fibers are sent through a combining or carding unit which further breaks apart and aligns the staple fibers in the machine-direction so as to form a machine-direction-oriented fibrous nonwoven web. Once the web has been formed, it is then bonded by one or more of several bonding methods. One bonding method is powder bonding wherein a powdered adhesive is distributed throughout the web and then activated, usually by heating the web and adhesive with hot air. Another bonding method is pattern bonding wherein heated calender rolls or ultrasonic bonding equipment is used to bond the fibers together, usually in a localized bond pattern through the web and or alternatively the web may be bonded across its entire surface if so desired. When using bicomponent staple fibers, through-air bonding equipment is, for many applications, especially advantageous.

As used herein the term "spunbond" refers to small diameter fibers which are formed by extruding molten thermoplastic material as filaments from a plurality of fine, usually circular capillaries of a spinneret, with the diameter of the extruded filaments being rapidly reduced, such as by methods and apparatus shown, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. No. 3,338,992 to Kinney, U.S. Pat. No. 3,341,394 to Kinney, and U.S. Pat. No. 3,542,615 to Dobo et al., each of which is incorporated herein by reference in its entirety in a manner that is consistent herewith.

As used herein, the term "meltblown" means fibers formed by extruding a molten thermoplastic material through a plurality of fine, usually circular die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, in various patents and publications, including NRL Report 4364, "Manufacture of Super-Fine Organic Fibers" by B. A. Wendt, E. L. Boone and D. D. Fluharty; NRL Report 5265, "An Improved Device For The Formation of Super-Fine Thermoplastic Fibers" by K. D. Lawrence, R. T. Lukas, J. A. Young; and U.S. Pat. No. 3,849,241, issued Nov. 19, 1974, to Butin, et al.; each of which is incorporated by reference in its entirety in a manner that is consistent herewith.

As used herein, the terms "layer" and "layer material" are interchangeable, and in the absence of a word modifier, refer to woven or knitted fabric materials, nonwoven fibrous webs, polymeric films, polymeric scrim-like materials, discontinuous or substantially continuous distributions of fibrous or particulate materials, polymeric foam materials and the like.

The basis weight of nonwoven fabrics or films is usually expressed in ounces of material per square yard (osy) or grams per square meter ($g/m^2$ or gsm) and the fiber diameters useful are usually expressed in micrometers or micro-inches. (Note that to convert from osy to gsm, multiply the osy value by 33.91). Film thicknesses may also be expressed in micrometers, micro-inches or mils.

As used herein, the term "thermoplastic" shall refer to a polymer which is capable of being melt processed.

As used in the specification and claims, the term "comprising" is inclusive or open-ended and does not exclude additional unrecited elements, compositional components, or method steps. Accordingly, such term is intended to be synonymous with the words "has", "have", "having", "includes", "including", and any derivatives of these words.

Unless otherwise indicated, percentages of components in formulations are by weight.

A method for forming a fibrous web (60) can include forming a plurality of fibers from a melt that has been provided from a base material which has included an operative amount of a selected polymer. In particular aspects, the fibers can be subjected to an anneal-quenching at a selected temperature, and the anneal-quench of the fibers can be conducted during a solidification of the fiber material from its molten state. In other aspects, the fibers can be subjected to a fiber-draw operation at a selected fiber-draw rate, and the fiber-draw can be conducted at a selected draw temperature. The plurality of fibers can then be deposited on a moving forming-surface to form the fibrous web.

Figure 1A:
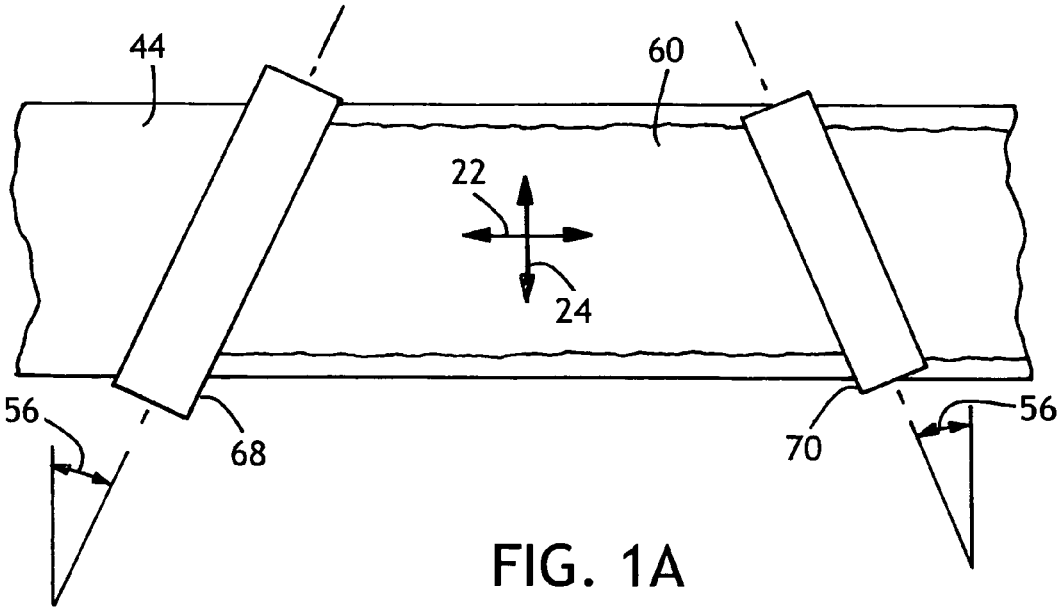
FIG. 1A illustrates a schematic, top view of a representative method of manufacturing fibers and nonwoven fabric webs in accordance with the invention.
Figure 2:
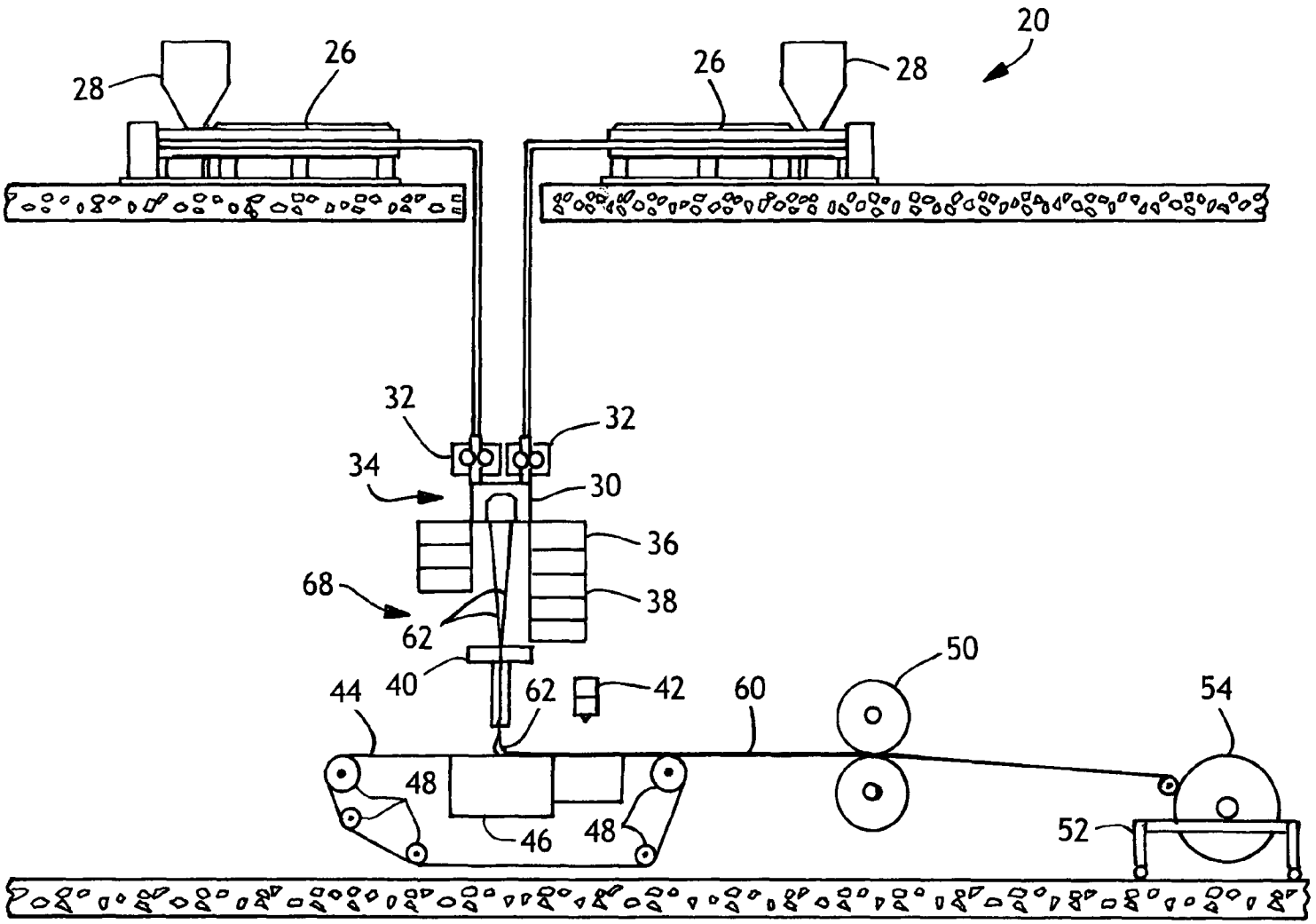
FIG. 2 schematically shows a representative system which incorporates the method employed to form fibers and nonwoven fabric webs in accordance with the invention.

With reference to FIGS. 1, 1A and 2, the method and apparatus 20 for making polymer fibers can have a machine-direction (MD) 22, and a cross-direction (CD) 24. The method can include providing a polymer fiber material that exhibits a low crystallization rate; and determining a prime-temperature at which the polymer material most rapidly crystallizes. The method can also include determining a prime temperature-range that includes the prime-temperature. In particular aspects, the fiber material can be subjected to an anneal-quench at an anneal-quench temperature that approximates the prime-temperature, and the anneal-quench of the fibers can be conducted during a solidification of the fiber material from its molten state. In other aspects, the fiber material can be subjected to a fiber-draw operation, and the fiber-draw operation can be conducted at a fiber-draw temperature that approximates the prime-temperature. Further aspects can include subjecting the fiber material to a fiber-draw at a relatively low fiber-draw speed, and subjecting the fiber material to a fiber-draw at a relatively low fiber draw down ratio.

The present invention can also provide a distinctive article which includes a plurality of fibers 62, wherein the fibers include a selected polymeric, fiber material. In a particular aspect, the fiber material can exhibit a slow crystallization rate. In other aspects, the polymer in the fibers can have a high crystallinity even when the fiber material has been subjected to a low fiber draw down ratio (DDR), and when the fiber material has been subjected to a low fiber-draw speed. In particular configurations, the fiber material can be subjected to a fiber draw down ratio of not more than a maximum of about 2000. In other configurations, the fiber-draw speed can be about 6000 m/min or less, or about 2500 m/min or less. Further aspects of the invention can include fibers which have a high tenacity, and the fibers can have a tenacity of at least a minimum of about 2000 dynes per denier (dyn/den), or 2.04 grams-force per denier (gf/den). In still other aspects, the fibers 62 can be configured to provide a fibrous web 60, and the fibrous web 60 can have a distinctive tensile strength quotient, with respect to tensile strengths along its cross-direction 24 and machine-direction 22.

By incorporating its various aspects and features, individually or in desired combinations, the polymer fibers and nonwoven fabrics of the invention can have improved dimensional stability, and can more readily accommodate desired thermal-processing operations. A nonwoven fabric, which includes the polymer fibers, can have desired physical properties in its machine-direction and cross-direction, and can be efficiently produced with less complex equipment.

The present invention can desirably be applied to polymer materials having poor crystallization kinetics. When employing conventional fiber spinning equipment, it has been difficult to efficiently process such polymer materials to produce desired polymer fibers and nonwoven fabrics. The produced fibers can show very low values of crystallinity and can shrink dramatically when heated during subsequent web-forming operations. For example, the fibers and fibrous webs can shrink dramatically when the webs are thermally bonded with selected bonding patterns employed to strengthen the web integrity. This shrinkage can lead to a poor stability of the fibrous spunbond and meltblown webs during and after production.

During the fiber production, a drawing and stretching of the polymer fibers at very high speed can help reduce the undesired fiber shrinkage. This drawing operation can, however, significantly complicate the process of forming the desired nonwoven fabrics, particularly when employing conventional spunbond and meltblowing machines to produce the spunbond and meltblown fabrics. Additionally, the operations employed to generate the high amounts of fiber-draw can result in excessively high fiber velocities, and a biased orientation or biased alignment of the fibers along the machine-direction of the manufacturing process and along the machine-direction of the nonwoven fabrics. The biased fiber orientation can excessively detract from a desired randomization of the fiber orientation in both the machine-direction and cross-direction of the fabric. The biased, machine-direction orientation of fibers can also disrupt in a desired balance of the fabric tensile properties relative to the machine-direction and cross-direction of the nonwoven fabric.

The incorporation of a very large amount of fiber draw can also result in narrow peaks when plotting an endothermic response of the melting, fiber polymer with a conventional, differential scanning calorimeter (DSC). When the polymer material of the fiber exhibits an excessively narrow endothermic peak during melting, it can be excessively difficult to thermally bond or otherwise thermally-process the nonwoven fabrics that are constructed with the polymer fibers.

In a particular aspect, the invention can include a providing of a fiber material that exhibits poor crystallization kinetics. The poor crystallization kinetics can for example, include one or more of the following characteristics or parameters: a slow nucleation rate; a slow crystallization rate due to molecular mobility constraints and diffusion control; a high glass transition temperature; and a slow crystallization rate at a prime temperature where the material most rapidly crystallizes.

The rate of crystallization can be important in desired fabrication applications, such as fiber spinning processes. Production difficulties can arise when processing fiber polymers with relatively slow crystallization rates. The slow crystallization rates can arise when the crystallization rates are hindered by slow nucleation. The slow crystallization rates can also arise when the crystallization rates are diffusion controlled as a result of molecular mobility constrains, or when the fiber polymers have high glass transition temperatures, such as glass transition temperatures above 18 degrees Celsius (° C.).

While the quantitative absolute values of the crystallization rates can vary significantly, a plot of the isothermal crystallization rates of these polymers with respect to the temperature at which the crystallization is conducted can exhibit a dependence represented by a generally bell-shaped curve. The crystallization rate can reach a maximum at a primary temperature that is within a particular temperature range, which is positioned below the melting temperature (Tm) and above the glass transition temperature (Tg) of the selected polymer material.

The fiber material can be a polymer which exhibits a slow crystallization rate, and the crystallization rate of a selected polymer material can be expressed in terms of a crystallization half-time of the material. The crystallization half-time is the time required for the crystallinity of the selected material to reach 50% of its equilibrium crystallinity. The equilibrium crystallinity is the maximum crystallinity level attainable by a material during isothermal crystallization. The crystallization half-time may be obtained experimentally by measuring the time needed to attain 50% of the equilibrium crystallization of the material, and can, for example, be determined by employing a differential scanning calorimeter.

The slow crystallization rate of the material can be represented by a long crystallization half-time of up to about 2000 sec, or more, as determined by differential scanning calorimetry. In a particular feature, the slow crystallization rate of the material can be represented by a crystallization half-time of not less than a minimum of about 300 sec, as determined by differential scanning calorimetry. The crystallization half-time can alternatively be not less than about 400 sec, and can optionally be not less than about 500 sec or 700 sec. In other configurations, the crystallization half-time can be not less than about 1000 sec. In contrast, a fast crystallizing material, such as polypropylene, can have the crystallization half-time of less than about 150 sec, or even less than 100 sec.

The crystallization process can be described in terms of a well known Avrami relation. The Avrami relation is, for example, described in a chapter "CRYSTALLIZATION KINETICS" in the *ENCYCLOPEDIA OF POLYMER SCIENCE AND ENGINEERING*, John Wiley & Sons, pages 231-241. The chapter gives also a general procedure for determining the Avrami parameters, "K" and "n" from bulk crystallization kinetics data. Additional information on determining the "K" and "n" parameters using a differential scanning calorimeter can be found in "The Rate of Crystallization of Poly(Ethylene terephthalate) by Differential Scanning Calorimetry" by C. C. Lin, *Polymer Engineering and Science*, February 1983, vol. 23, No. 3 (Ref. A).

For a selected material, the Avrami constant "K" can be graphically plotted as a function of temperature. For the present disclosure, the peak in the graphical plot of the Avrami constant corresponds to the peak in the crystallization rate of the selected material. Accordingly, the temperature at which the peak in the plot of the Avrami constant occurs will correspond to the prime-temperature at which the maximum crystallization rate of the selected material occurs.

Information pertaining to this behavior can be found in "The Rate of Crystallization of Poly(Ethylene terephthalate) by Differential Scanning Calorimetry" by C. C. Lin, *Polymer Engineering and Science*, February 1983, vol. 23, No. 3 (Ref. A). As illustrated in FIG. 4 of this publication, the maximum crystallization rate, as represented in terms of the Avrami constant K, can depend on the molecular weight of the polymer. The crystallization rate has a similar bell-shape type of dependence versus the crystallization temperature, with the crystallization rate reaching a maximum at a particular temperature. The molecular structure of the polymer can also significantly affect the maximum value of crystallization rate, as well as temperature at which maximum crystallization rate is achieved. For example, see "Isothermal Crystallization Kinetics of Commercially Important Polyalkylene Terephthalates" by B. J. Chisholm and J. G. Zimmer, 2000CRD002, March 2000, *Technical Information Series*, GE Research & Development Center (Ref. B).

Examples of polymers with slow crystallization rates can, for example, include polyalkylene terephthalates such as polyethylene terephthalate (PET), segmented block polyurethanes (e.g. polyurethanes derived from aliphatic polyols), and aliphatic-aromatic copolyesters, or the like, as well as combinations thereof. These polymers are typically non-biodegradable.

Other examples of polymers with slow crystallization rates can include biodegradable polymers. Such polymers can include polymers and copolymers of polylactic acid, polymers and copolymers of polyglycolic acid, diacids/diols aliphatic polyesters, degradable BIOMAX polymers based on polyethylene terephthalate technology, which are available from DuPont; biodegradable polyester carbonates available from Mitsubishi Gas Chemical; polyhydroxy alkanoate polymers and copolymers, including poly(3-hydroxyalkanoates) including poly(3-hydroxybutyrates), poly(3-hydroxyhexanoates), poly(3-hydroxyalkanoates) copolymers such as poly(hydroxybutyrate-cohydroxyvalerate), poly(hydroxybutyrate-cohydroxyhexanoate) and other poly(hydroxy alkanoates) or the like, as well as combinations thereof. Suitable materials are available from Tianan Biologic Material Co., LTD, a business having offices in Ningbo, China, Metabolix, a business having offices in Cambridge, Mass., U.S.A. and the Proctor & Gamble Company, For example, polylactic acid (PLA) polymer materials can exhibit a maximum isothermal crystallization rate at a temperature of about 105° C. The crystallization rate of the PLA polymers can significantly decline at high temperatures of about 125° C. or higher, and at low temperatures of about 80° C. or lower. The crystallization rate decline at high temperatures above about 125° C. is related to, a limited nucleation potential of the PLA polymer, while the crystallization rate decline at temperatures below about 80° C. is associated with restricted molecular diffusion and the approaching glass transition temperature, which for PLA is about 62° C.

Absolute values of the crystallization rate can also be affected by various other factors, such as the molecular weight of the polymer, the addition of nucleating agents, and the use of plasticizing additives to improve molecular mobility. In particular features, the base, fiber resin material (e.g. PLA resin material) can be configured to include one or more plasticizing agents or plasticizers, and/or can be configured to include one or more nucleating agents. The plasticizer can reduce the constraints to the mobility of the molecules of the fiber polymer during the crystallization of the fiber polymer material, and can help provide higher crystallization rates within a broader thermal window. Suitable plasticizers can, for example, include polyethylene glycol (PEG) and lower molecular weight versions of the fiber polymer (e.g. lower molecular weight PLA polymers). Other operative plasticizers may be incorporated, and combinations of plasticizers may optionally be employed. Examples of other suitable plasticizers include phthalic acid derivatives (e.g., dioctyl phthalate), citric acid derivatives (e.g., tri-n-butyl citrate), glycerol esters (e.g. glycerol triacetate), tricarboxilic esters, citrate esters, and dicarboxylic esters. For example, a suitable plasticizer can include CITROFLEX A4, which is available from Morflex, a business having offices located in Greensboro, N.C., U.S.A. The plasticizer can help reduce mobility constrains that may be encountered during the anneal-quenching, can reduce glass transition temperature of the fiber polymers, and can help provide higher crystallization rates in a broader thermal window. The amount of plasticizer in the fiber polymer composition can desirably be not more than 10% by weight (10 wt %), and can more desirably be not more than about 5% by weight (5 wt %). Larger amounts of plasticizer can negatively affect fiber properties, such as the fiber melt strength and the fiber tenacity. Also, excessive amounts of a volatile plasticizer can cause an undesired fouling of the process equipment.

The nucleating agents can help raise the onset temperature for crystallization, and can also help to provide increased crystallization rates at elevated, anneal-quench temperatures. Suitable nucleating agents can include particulate additives, self assembling nucleating agents, reactive nucleating agents or the like, as well as combinations thereof. Particulate additives can, for example, include talc titanium dioxide, silica, nano clays, sodium salt, calcium titanate, and metal oxides and hydroxides. Examples of self-assembling nucleating agents can include bis(p-methylbenzylidene)sorbitol such as MILLAD materials, e.g., MILLAD 3988 and MILLAD 8C41-10 which are available from Milliken Chemical, a business having offices located in Spartanburg, S.C., U.S.A. Other examples can include dibenzylidene sorbitol and its derivatives, monobenzylidene sorbitol (MBS), and bis (p-methylbenzylidene)sorbitol, e.g., NC-4 material which can be purchased from Mitsui Toatsu Chemicals. Reactive nucleating agents can, for example, include metal salts, 4-biphenyl carboxylic acid, 4-biphenylmethanol, and adipic acid.

The amount of nucleating agents in the fiber polymer composition can desirably be not more than 10% by weight (10 wt %), and can more desirably be not more than about 5% by weight (5 wt %). Overly large amounts of the employed nucleating agents may excessively degrade the desired fiber properties.

One or more selected plasticizers and one or more selected nucleating agents may be operatively combined and blended with the fiber polymer resin (e.g. PLA resin) to provide distinctive improvements in the crystallization rate over a significantly broader temperature range. Such advantages can be especially beneficial for a spunbond process or other meltblowing processes in which the opportunities for providing draw-induced, molecular orientation in the fiber polymer may be limited.

Another aspect of the invention can include a determining of a prime-temperature at which the selected polymer material most rapidly crystallizes. The invention can also include a determining of a prime temperature-range that includes the prime-temperature. A suitable method of determining a prime-temperature range that includes a prime-temperature at which the polymer most rapidly crystallizes is a method which employs differential scanning calorimetry (DSC), as described in Ref. A by C. C. Lin, and in Ref. B by B. J. Chisholm and J. G. Zimmer. The method described in Ref. A can provide a direct method of appropriately identifying the prime-temperature of a selected fiber polymer, and a corresponding prime-temperature range. Employing this direct method found a prime-temperature for PLA of about 105° C. It can also be observed that the prime-temperature for PET is in a range between 170° C. and 180° C.

In particular aspects, the present invention can be configured to process biodegradable, polylactic acid (PLA) polymers and to produce fibers and nonwoven fabrics having improved properties and dimensional stability. The PLA fibers and nonwoven fabrics can be employed to manufacture desired articles that are intended to be biodegradable. In a desired aspect, PLA spunbond webs can have improved properties, such as enhanced crystallinity, reduced shrinkage, improved tenacity, improved web formation, and improved wettability. Additionally, the improved fibers and fabrics can be produced while employing conventional and readily available, fiber spinning equipment. In another aspect, the method of the invention can efficiently make PLA webs having desired, improved properties. In further aspects, the method can include extruding PLA melts or PLA melt-compositions, and the melts and melt-compositions can contain selected amounts of additives, which can increase a crystallization rate of the PLA. Still other aspects can include a configuring of the melt spinning conditions to enhance a desired molecular orientation in the polymer materials; and an anneal-quenching of the fiber melt by subjecting the forming fibers to a temperature or temperature range that can increase the crystallization rate of the PLA melt. An additional aspect can include an operative drawing or stretching of the formed fibers at distinctive drawing-speeds and drawing-temperatures that can enhance the molecular-orientation and crystallization induced by the drawing operation. Accordingly, the method of the invention can effectively and efficiently provide PLA fibers and nonwovens having improved properties using conventional, readily available spunbond or meltblown processing equipment. The PLA fibers and nonwoven fabrics can be particularly useful for disposable hygiene products.

When formed into fibers and fibrous webs, the PLA polymer can, however, exhibit very low crystallinity, and can shrink up to about 50% when heated above about 60° C., which is the glass transition temperature (Tg) of the PLA polymer. This shrinkage can lead to poor stability of the PLA spunbond and meltblown webs during and after production. Although a drawing of the PLA fibers at very high speed can reduce the fiber shrinkage, it has been desirable to avoid excessive increases in the amount of fiber draw, for the reasons set forth in the present disclosure.

In a desired aspect, the PLA polymers suitable for this invention can be in a semicrystalline form. The desired range of compositions for semi-crystalline poly(lactide) has less than about 6% by weight of meso-lactide and a remaining percent by weight of either L-lactide or D-lactide, with L-lactide being preferred and more readily available. A desired composition of a semi-crystalline PLA polymer can have less than about 3% by weight of meso-lactide and a remaining percent by weight of L-lactide. A lesser amount of meso-lactide is desired because even a small amount of meso-lactide can reduce the crystallization rate of a PLA polymer and can reduce the overall level of crystallinity. In another configuration, the PLA polymer can be a copolymer of L-lactide and D-lactide. In general, the copolymer composition can have a (D-lactide):(L-lactide) ratio which is in the range of about 100:0-95:5, and is alternatively in the range of about 5:95-0:100. In still another embodiment the PLA polymer composition can have D-lactide/L-lactide ratio of about 50:50. In a desired configuration, the PLA composition can have less than 5 wt % of D-lactide, with the remaining weight percentage being L-lactide. More desirably, the PLA composition can have less than 2 wt % of D-lactide, with the remaining weight percentage being L-lactide. Lower amounts of the D-lactide component can increase the crystallization rate and the overall crystallinity of PLA fiber material. A detailed description of the synthesis and composition of PLA polymers can be found in "Polylactides" by H. Tsuji, *Biopolymers Volume* 4, *Polyesters III Applications and Commercial Products*, Edited by Y. Doi and A. Steinbuchel, Wiley-V C H; and in "A Literature Review of Poly(lactic Acid)" by D. Garlotta, *Journal of Polymers and the Environment*, Vol. 9, No. 2, April, 2001. The entire disclosures of these publications are incorporated herein by reference in a manner that is consistent herewith.

The PLA polymers of the present invention are melt extrudable, and can be readily spun into fibers. Additionally, the fibers can be processed to form nonwoven fabrics employing conventional techniques for forming fibrous webs, such as spunbonding and meltblowing techniques. For forming spunbond, fibrous nonwoven webs, the PLA polymer can have a high molecular weight. In a particular aspect, the polymer can have a number-average molecular weight (MWn) which is within the range of about 45,000 Daltons to about 200,000 Daltons. In a desired aspect, the number-average molecular weight can be within the range of about 70,000 Daltons to about 150,000 Daltons. For forming meltblown fibrous webs, the PLA polymer can have a number-average molecular weight which is within the range of about 15,000 Daltons to about 80,000 Daltons. In a desired arrangement, the meltblown polymer can have a number-average molecular weight which is within the range of about 20,000 Daltons to about 60,000 Daltons.

The PLA polymers useful for the present invention can be configured to have a sufficient level of melt stability. Accordingly, the polymers do not excessively degrade during the extrusion and fiber spinning operations, which are typically conducted at high temperatures. Since the moisture concentration and/or water content can affect the melt stability of the PLA polymers during processing, the PLA polymer composition before processing has a moisture content of less than 1000 parts-per-million. The moisture content in the PLA polymer composition is desirably less than 500 parts-per-million, and is more desirably less than 100 parts-per-million. Even more desirably, the moisture content of the PLA material can be less than 50 parts-per-million. The presence of water can cause an excessive loss of molecular weight during the extrusion and the fiber spinning of the PLA polymer. The loss of molecular weight can excessively degrade the processibility and physical properties of PLA fibers and webs. To improve the melt stability and processibility of the PLA material, the composition of the PLA material desirably includes less than about 2 wt % of a residual monomer. More desirably, the residual monomer concentration can be less than 1 wt %, even more desirably, the residual monomer concentration can be less than 0.5 wt %. To improve the processibility and melt stability of the PLA polymer composition, antioxidants and water scavengers can be added to the PLA polymer composition. Such antioxidants and water scavengers are conventional and well known in the art.

To provide further improvements, the PLA polymer may also exhibit one or more additional parameters or characteristics. In particular features, the PLA polymer can have a melting temperature of not less than 120° C. and a glass transition temperature of not more than 80° C. In another feature, the PLA polymer can have a melt flow rate (MFR) value of not less than 15 grams/10 min, measured at 230° C. and a load of 2.16 kg/cm$^2$, based on ASTM D1238, to provide desired levels of processibility.

Suitable, melt stable lactide polymers are described in U.S. Pat. No. 6,355,772 B1 to P. R. Gruber et. al., the entire disclosure of which is incorporated herein by reference in a manner that is consistent herewith. Examples of commercially available, PLA polymers can include a variety of polylactic acid polymers; such as L9000 polymer, available from Biomer, a business having offices located at Forst-Kasten-Str. 15, D-82152 Krailling, Germany; NatureWorks PLA polymers available from NatureWorks LLC, a business having offices located in Minnetonka, Minn., U.S.A.; and LACEA PLA polymers available from Mitsui Chemical, a business having offices located in Chiba, Japan.

The polymer fibers and fabric webs of the invention can be constructed by employing various types of equipment. Such equipment is conventional and well known. For example, the polymer fibers and fabric webs may be produced by employing extrusion and/or melt-forming equipment. In particular configurations, the polymer fibers and fabric webs can be produced by employing conventional spunbond equipment or meltblowing equipment.

With reference to FIGS. 1, 1A and 2, the method and apparatus 20 for forming polymer fibers 62 and a fibrous web 60 can have a machine-direction 22 and a cross-direction 24. The method and apparatus 20 can deposit polymer fibers 62 directly onto an operative conveyor system to form a nonwoven fabric web 60. The conveyor system can include a porous forming surface system 44 (e.g., a foraminous, forming-wire belt) moving about a cooperating system of rollers 48. A primary bank of fiber-forming mechanisms 68 can operatively form the polymer fibers 62, and a vacuum system 46 can generate an operative vacuum force to help gather and hold the deposited fibers 62 against the foraminous forming surface 44. In desired aspects, the fiber-forming mechanisms can be configured to operatively form fibers 62 having selected sizes and compositions from a melt of the polymer fiber material. The polymer fibers 62, can include any suitable material, such as the materials disclosed herein, and the fiber material can be extruded and fiberized from the fiber-forming bank 68, such that the formed fibers 62 are operatively placed onto the forming surface 44. It should be readily appreciated that a plurality of two or more fiber-forming banks 68 may be employed to form the fibrous web 60 into desired basis weights.

One or more additional fiber-forming banks 70 can optionally be positioned and employed downstream from the first fiber-forming banks 68, and can be configured to extrude additional types and amounts of supplemental fibers 72 to form additional layers, strata or other additional sections of the nonwoven fibrous web 60. The fabric web 60 may optionally be compacted or otherwise treated by any desired processing system. To melt the materials of the selected surface modifying agent, a grid melter (or other conventional system of hot melt equipment) may be employed, and the selected material may be supplied to the melting operation in any operative form, such as in drums, pellets, blocks or the like.

As representatively shown in FIG. 1A, one or more of the employed fiber-forming banks (68, 70) may be arranged with its longitudinal length aligned at a selected forming angle 56 relative to the cross-direction 24. The forming angle can, for example, be up to about plus or minus (±) 45° relative to the cross-direction 24.

With reference to FIG. 2, the method and apparatus 20 can include at least one, and alternatively, a plurality of extruders 26, 26*a*. Each extruder can include a corresponding hopper or other reservoir 28, 28*a* to operatively supply an appropriate combination of the constituents of the desired fiber material. The employed extruders can be configured to provide the same fiber material, or different fiber materials, as desired. Accordingly, each extruder can produce a melt that has been provided from a source of a base material which has included an operative amount of a selected base polymer. In a desired configuration, the base polymer can include at least a selected weight percentage of a polylactic acid polymer.

The fiber material from each extruder can be delivered through conventional conduits to a system of spin pumps 32 which delivers molten polymer at a predetermined mass flow rate to the spin pack assembly. Each fiber material is operatively delivered from the spin pumps to a spin beam 34, which includes an operative system of flow lines to various parts of the spin beam to ensure a substantially uniform flow of molten polymer to each hole in the spin plate.

Fiber filaments of the melt material are melt-spun or melt-blown from one or more spin-packs that are operatively distributed along the cross-direction of the method and apparatus. Suitable spin packs are available from commercial vendors. A sufficient number of spin-packs are operatively arranged and employed to produce a desired cross-directional width of the nonwoven fabric 60. For example, an operative number of spin-packs are suitably arranged and configured to produce each primary fiber-forming bank 68 that is employed to produce the desired cross-directional width of the nonwoven fabric web 60.

At least a significant portion of the fiber filaments, and desirably, at least about 95 wt % of the fiber filaments can then be subjected to a distinctive anneal-quench operation, which can be conducted during an operative solidification of the fiber material from its molten state. In a particular aspect of the invention, the formed fiber filaments can be exposed and subjected to an operative anneal-quench temperature that approximates the prime-temperature of the selected material employed to form the polymer fibers 62. In desired configurations, the anneal-quench temperature can be within a prime-temperature range that includes the prime-temperature. The prime-temperature range of most rapid crystallization rate of a polymer material can be identified prior to converting a polymer material into fibers. During the fiber converting operation, it is desirable to maximize the crystallization rate to achieve a maximum amount of crystallinity in the fiber material during the short residence time when fiber is being spun. To help accomplish this, the extruded fiber material can be subjected to an anneal-quench at an anneal-quench temperature that approximates the prime-temperature. In desired aspects, the anneal-quench temperature can be not more than 30° C. higher than the prime-temperature, and/or not more than 30° C. lower than the prime-temperature. Alternatively, the anneal-quench temperature can be not more than 10° C. higher than the prime-temperature and/or not more than 10° C. lower than the prime-temperature. Optionally, the anneal-quench temperature can be not more than 5° C. higher than the prime-temperature, and/or not more than 5° C. lower than the prime-temperature to provide improved effectiveness.

In another aspect, the anneal-quench temperature can be configured to be at least about 10° C. higher than the glass transition temperature of the polymer material. Further aspects can have a configuration in which the anneal-quench temperature is at least about 20° C. or at least about 40° C. higher than the glass transition temperature of the polymer material to provide desired performance.

As the anneal-quench temperature is configured to be further and further below the prime temperature of the polymer, greater-amounts of fiber-draw and the higher fiber-draw speeds are required to achieve desired levels of fiber crystallinity and/or desired levels of low heat shrinkage. For example, with an anneal-quench temperature of about 30° C. below the prime temperature of the fiber polymer, a fiber velocity or speed of higher than about 5000 m/min may be required to achieve the desired performance. When anneal-quench temperature is approximately equal to the prime temperature of the fiber polymer, a fiber velocity of less than about 4000 m/min, or even less than 3000 m/min may be required.

For example, when arranged to produce fibers that include PLA polymer material, the invention can be configured to employ an anneal-quench temperature which is operatively proximate the prime-temperature of the PLA material. In a particular aspect, the anneal-quench temperature can be at least a minimum of about 70° C. The anneal-quench temperature can alternatively be at least about 95° C., and can optionally be at least about 100° C. to provide desired benefits. In other aspects, the anneal-quench temperature can be up to a maximum of about 125° C. The anneal-quench temperature can alternatively be up to about 115° C., and can optionally be up to about 110° C. to provide desired effectiveness. In the case when the anneal-quench temperature is about 70° C., the PLA fiber velocity may need to be about 5000 m/min or more to achieve a desired high level of fiber crystallinity and a desired low level of fiber shrinkage. When the anneal-quench temperature operatively proximate the prime temperature of the PLA material the PLA fiber velocity can be about 3000 m/min or less to achieve desired high values of fiber crystallinity and low values of fiber shrinkage.

In a desired configuration, the anneal-quench operation can by conducted by subjecting the melt-formed, fiber filaments to air or other gas which has been provided at the desired anneal-quench temperature. As representatively shown, for example, a temperature-controlled air system 38 can be employed to anneal-quench and operatively solidify the fiber filaments. Alternatively, any operative, regulated cooling system may be arranged to suitably cool and solidify the fiber filaments of polymer material. Such systems are conventional and available from commercial vendors.

The solidified filaments can be delivered from the anneal-quench operation to an operative drawing or stretching operation, and the desired fiber-drawing operation can, for example, be conducted by employing a fiber drawing unit (FDU) 40. As representatively shown, the drawing operation and the fiber drawing unit 40 can employ a pressurized pneumatic system to extend and draw the solid, fiber filaments to a desired amount of elongation, and to provide desired fiber sizes.

In a particular aspect, the invention can optionally include a subjecting of the material of the fibers 62 to a fiber-draw while the fiber material is subjected to a fiber-draw temperature that is operatively proximate the prime-temperature of the selected material employed to form the polymer fibers 62. In desired aspects, the fiber-draw temperature can be not more than about 20° C. higher than the prime-temperature, and/or not more than about 30° C. lower than prime-temperature. In alternative features, the fiber-draw temperatures can be not more than about 10° C. higher than prime-temperature, and/or not more than about 10° C. lower than prime-temperature. Optionally, the fiber-draw temperature can be not more than about 5° C. higher than the prime-temperature, and/or not more than 5° C. lower than the prime-temperature to provided improved effectiveness. In another aspect, the fiber draw temperature can be at least about 10° C. higher than the glass transition temperature of polymer material. Desirably, the fiber draw temperature can be at least about 40° C. higher than the glass transition temperature of the polymer material to provide desired performance.

For example, when arranged to produce fibers of PLA polymer material, the method of the invention can be configured to employ a fiber-draw temperature which is proximate the prime-temperature of the PLA material. In a particular aspect, the fiber-draw temperature can be at least a minimum of about 70° C. The fiber-draw temperature can alternatively be at least about 95° C., and can optionally be at least about 100° C. to provide desired benefits. In other aspects, the fiber-draw temperature can be up to a maximum of about 125° C. The fiber-draw temperature can alternatively be up to about 115° C., and can optionally be up to about 110° C. to provide desired effectiveness.

Employing a fiber-draw temperature that is proximate to the prime-temperature can help provide various improvements. For example, approximating the fiber-draw temperature to the prime-temperature, can help increase fiber tenacity, and can reduce the fiber velocity needed to achieve a desired level of fiber crystallinity. The fiber velocity, however, is desirably maintained at a value that is sufficient to avoid excessive fiber roping and excessive sticking of fibers inside a fiber-draw unit.

The drawing operation can also be configured to employ relatively low, fiber-draw velocities and speeds. In particular aspects, the fiber-draw speed can be at least a minimum of about 600 m/min. The fiber-draw speed can alternatively be at least about 800 m/min, and can optionally be at least about 1000 m/min to provide desired benefits. Other configurations can include a fiber-draw speed of at least about 2000 m/min. In other aspects, the fiber-draw speed can be up to a maximum of about 7000 m/min. The fiber-draw speed can alternatively be up to about 5000 m/min, and can optionally be up to about 4000 m/min to provide desired performance. Other configurations can include a fiber-draw speed of up to about 2500 m/min or up to about 3000 m/min to provide desired operating efficiencies. For purposes of the present disclosure, the fiber-draw speed is the speed of the formed fiber at the exit from the fiber drawing unit 40.

A suitable technique for determining the fiber-draw speed can be provided by employing the following:

$$\text{Fiber Draw Speed}(V_f)=[(4G*10^8)/(\rho_f*(\pi*D_f)^2)];$$

where

G=mass flow rate per minute per hole, g/min per hole;

$\rho_f$=density of fiber material, g/cm$^3$;

$D_f$=diameter of collected fibers, microns (μm).

An excessively high fiber-draw speed can produce excessively high fiber speeds during the formation of the fibrous web 60, and the high fiber speeds can produce a fiber orientation which is excessively biased along the machine-direction 22 of the production process. The relatively low fiber speeds employed by the invention can help produce nonwoven fabrics that have a more random orientation of the fibers, and can help provide a nonwoven fabric web 60 having more uniform properties.

In another aspect, the fiber material can be subjected to a fiber draw down ratio (DDR) of 2000 or less. In desired configurations, the fiber draw down ratio can be at least a minimum of about 300. The fiber draw down ratio can alternatively be at least about 600, and can optionally be at least about 1000 to provide desired benefits. In other arrangements, fiber draw down ratio can be up to a maximum of about 3000, and can alternatively be up to about 4000, or more.

A suitable technique for determining the fiber draw down ratio can be provided by the following:

$$\text{Fiber Draw Down Ratio(DDR)}=V_f/V_h;$$

where: $V_h$=velocity of polymer mass at the hole of the spin plate in the selected spin pack.

The term, $V_h$ can further be calculated as follows:

$$V_h=(4G*10^8)/(\rho_m*(\pi*D_h)^2)$$

where:

G=mass flow rate per minute per hole, g/min;

$\rho_m$=melt density of polymer, g/cm$^3$;

$D_h$=diameter of hole, microns (μm).

Accordingly:

$$\text{Fiber Draw Down Ratio(DDR)}=V_f/V_h=[\rho_m_*(D_h)^2]/(\rho_f*(D_f)^2).$$

To form the fibrous web 60, the formed fibers can be deposited and gathered on the moving, foraminous forming surface 44. Various types of conventional forming surfaces and forming systems, such as systems that include forming drums and forming belts, are well known in the art. As representatively shown, for example, the forming surface 44 can be provided by an endless forming-wire belt that is operatively carried and moved at a selected speed by a system of transport rollers 48 and a conventional drive system. A conventional vacuum system 46 can be positioned subjacent the moving forming-wire to help direct the fibers to the forming belt, and to deposit and collect the polymer fibers on the forming surface.

The forming surface 44 can be transported or otherwise moved along the machine-direction 22 at a selected surface speed. In a particular aspect, the surface speed can be at least a minimum of about 100 m/sec. The surface speed can alternatively be at least about 200 m/sec, and can optionally be at least about 300 m/sec to provide desired benefits. In other aspects, the surface speed can be up to a maximum of about 1500 m/sec, or more. The surface speed can alternatively be up to about 1200 m/sec, and can optionally be up to about 1000 m/sec to provide desired effectiveness.

High surface speeds are ordinarily desired to economically manufacture a spunbond or other nonwoven fibrous web, but the amount of polymer that can be extruded through each fiber-forming hole per unit of time (e.g. grams per hole per minute) is often an important limitation. At a desired, moderate throughput of polymer, an excessively high speed of the forming surface can result in an excessively low basis weight of the nonwovens. The low basis weight nonwovens can have insufficient tensile strength and can provide insufficient coverage. Such deficiencies can produce inferior performance when the low basis weight nonwoven fabrics are incorporated into personal hygiene products. Similarly, excessively low speeds of the forming surface can undesirably increase the costs of the nonwoven fabrics due to less efficient, slow production rates.

In desired configurations of the invention, the formed fibers can be deposited and accumulated on the moving, foraminous forming surface 44 after being processed and stretched by a pneumatic fiber drawing unit 40. In a particular feature, the formed fibers can be deposited and accumulated directly on the moving, foraminous forming surface in an operation that occurs substantially immediately after being processed and stretched by the pneumatic fiber drawing unit. In a further feature, the formed fibers can be moved substantially directly from the pneumatic drawing unit onto the foraminous forming surface without being subjected to any intervening stretching conducted with non-pneumatic mechanisms or systems, such as devices that employ a system of Godet rollers or employ a sliding, frictional contact with a tension-applying roller.

The invention can also be configured to include a depositing of the plurality of fibers 62 on the moving forming surface 44 to provide a selected fibrous basis weight. In particular aspects of the invention, the basis weight of the formed fibrous web can be at least a minimum of about 15 g/m$^2$. The basis weight of the fibrous web can alternatively be at least about 20 g/m$^2$, and can optionally be at least about 24 g/m$^2$ to provide desired benefits. In other aspects, the basis weight of the fibrous web 60 can be up to a maximum of about 30 g/m$^2$, or more. The basis weight of the fibrous web can alternatively be up to about 27 g/m$^2$, and can optionally be up to about 26 g/m$^2$ to provide desired effectiveness.

If the basis weight of the formed fibrous web 60 is too low, the fibrous web can be excessively weak. If the basis weight is too high, the fibrous web may have an excessively low permeability to liquids or may have an excessively high cost of manufacture.

A heated air knife 42 can be positioned over the nonwoven fibrous web 60 to help increase a tensile strength of the web, and to facilitate the handling of the web during subsequent processing operations. To accomplish these tasks, the heated air knife can be configured to provide a minimal tensile strength to the fiber web so that it can be smoothly transferred to the bonding rolls without breakage. The height, air temperature and airflow rates of the heated air knife can be adjusted to provide the desired operational results. The hot air knife can be a device which operatively focuses and directs a stream of heated air at a very high flow rate towards the nonwoven web immediately after its formation. The high flow rate can be within the range of about 1000-10000 feet per minute (fpm) or about 305-3050 meters per minute. Examples of a suitable heated air knife are described in U.S. Pat. No. 5,707,468 entitled COMPACTION-FREE METHOD OF INCREASING THE INTEGRITY OF A NONWOVEN WEB by Arnold et al., which issued 13 Jan. 1998.

As representatively shown, the nonwoven fibrous web 60 can be further processed in any desired manner. For example, the web can be consolidated by employing various methods, such as thermal bonding (heat and pressure), needle-punching, chemical bonding, hydroentangling or the like, as well as combinations thereof. In desired configurations of the invention, the nonwoven fibrous web 60 may be operatively delivered to a nip region between a system of counter-rotating rollers 50 for further processing. Operatively arranged in one or more cooperating pairs, the processing rollers 50 can, for example, be configured to provide a compression calendar operation, an embossing operation, a thermal-processing operation, a thermal bonding operation or the like, as well as combinations thereof.

In a desired arrangement, the processing rollers 50 can be configured to thermally bond the fibrous web 60 with a selected bonding pattern. In particular features, a system of thermal bonding rollers can be configured to provide a desired thermal bonding pattern, and can be operatively heated to a selected bonding temperature. The bonding temperature can be configured to be operatively proximate a melting point of the fiber material in the nonwoven web 60.

The fibrous web can then be accumulated for storage and transport by employing any operative process or system. As representatively shown, for example, a conventional winder 52 may be employed to accumulate the fibrous web into a roll 54.

Excess process air from the fiber filament-forming operation can be operatively removed from the production operation by employing a conventional, fume exhaust system 36. Various exhaust systems are well known and available from commercial vendors.

A distinctive interplay between fiber material variables and process variables can help produce polymer fibers and nonwoven fabrics (e.g. spunbond nonwovens) which can exhibit low shrinkage, enhanced crystallinity, improved formation and improved properties, such as improved tensile properties and improved fluid management properties. The fibers and nonwoven fabrics can be produced while employing less complex equipment and relatively low, fiber draw speeds.

A total crystallinity value and an enthalpy of recrystallization value can be features that help characterize the crystalline structure of the polymer fibers and nonwoven fabrics of the invention. The recrystallization process is a type of crystallization, which takes place at temperatures above the glass transition temperature (Tg) and below the melting temperature (Tm) of the fiber material. A lower level of recrystallization and a greater level of the overall crystallinity of the fiber material can provide greater dimensional stability and lower heat shrinkage in the produced fibers and nonwoven fabrics. Conventional techniques and equipment, such as X-ray diffraction techniques, and differential scanning calorimetry (DSC) techniques, can be employed to determine the level of crystallinity and characterize the fiber structure. Also, a melting-peak width and a melting-peak composition of a melting endotherm determined by the DSC can be employed to describe the features of the fibers and fabric webs of the invention.

Another feature of the invention can provide fibers having a desired fiber size, in terms of an effective diameter. In particular aspects, the fiber size can be at least a minimum of about 5 μm. The fiber size can alternatively be at least about 6 μm, and can optionally be at least about 8 μm to provide desired benefits. In other aspects, the fiber size can be up to a maximum of about 30 μm, or more. The fiber size can alternatively be up to about 20 μm, and can optionally be up to about 12 μm or 15 μm to provide desired effectiveness.

If the fiber size is too large, the nonwoven can have excessively coarse and rough tactile properties, may not provide adequate coverage (barrier), and may exhibit an excessive permeability. If the fiber size is too low the nonwoven may exhibit an excessively low permeability that can degrade its liquid handling properties.

Figure 18:
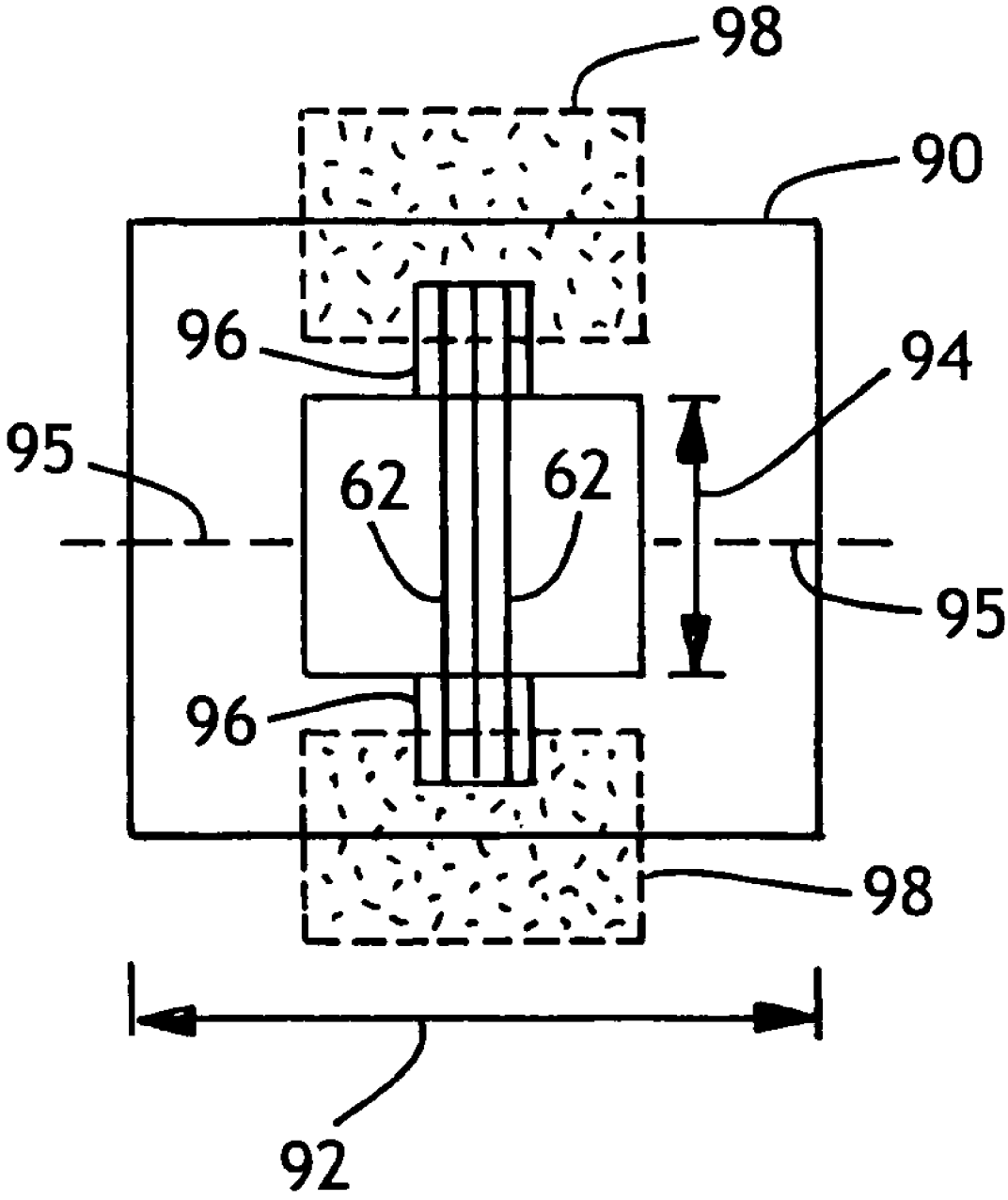
FIG. 18 shows a schematic view of a plurality of fiber specimens mounted for viewing and testing.

The effective fiber size diameter can be determined in accordance with the following test procedure: Individual fiber specimens are carefully extracted from an unbonded portion of a fiber web in a manner that does not significantly pull on the fibers. These fiber specimens are shortened (e.g. cut with scissors) to 1.5 inch (38 mm) length, and placed separately on a black velvet cloth. 10 to 15 fiber specimens are collected in this manner. These fiber specimens are then mounted on a rectangular paper frame having 51 mm×51 mm external dimensions, and 25 mm×25 mm internal dimensions. The ends of each specimen can be secured to the frame by carefully taping the fiber ends to the sides of the frame (e.g. see FIG. 18). Each fiber specimen is then measured for its external, relatively shorter, cross-fiber dimension employing a conventional laboratory microscope, which has been properly calibrated and set at 40 times magnification. This cross-fiber dimension is recorded as the diameter of the fiber specimen. The diameters from all of the 10-15 fiber specimens are arithmetically averaged to determine the diameter of the selected fiber. Desirably, the standard deviation of the specimen diameters may also be determined and recorded.

Fibers and nonwoven fabrics with improved properties can be produced by employing the method and apparatus of the invention. Fibers of the invention can be configured to have a high tenacity, even when the fibers have been subjected to a low value of fiber-draw (e.g. a low fiber-draw speed and/or a low draw down ratio). In a particular aspect, the polymer fiber of the invention can have a tenacity of at least about 2000 dynes per denier (dyn/den), or about 2.04 grams-force per denier of fiber (gf/den). The fibers can desirably have a tenacity of at least about 2500 dyn/den, and can more desirably have a tenacity of at least about 3000 dyn/den to provide improved benefits.

The fiber tenacity and other parameters can be determined by employing the following tensile testing procedure. Individual fiber specimens 62 are carefully extracted from an unbonded portion of a fiber web in a manner that does not significantly pull on the fibers. These fiber specimens are shortened (e.g. cut with scissors) to 1.5 inch (38 mm) length, and placed separately on a black velvet cloth. 10 to 15 fiber specimens are collected in this manner. The fiber specimens are then mounted in a substantially straight condition on a rectangular paper frame 90 having 51 mm×51 mm external dimensions 92, and 25 mm×25 mm internal dimensions 94. The ends of each fiber specimen can be operatively attached to the frame by carefully securing the fiber ends to the sides of the frame with adhesive tape 96. An appropriate arrangement is representatively illustrated in FIG. 18. Each fiber specimen can then be measured for its external, relatively shorter, cross-fiber dimension employing a conventional laboratory microscope, which has been properly calibrated and set at 40 times magnification. This cross-fiber dimension is recorded as the diameter of the individual fiber specimen. The frame 90 helps to mount the ends of the sample fiber specimens in the upper and lower grips 98 of a constant rate of extension type tensile tester in a manner that avoids excessive damage to the fiber specimens.

A constant rate of extension type of tensile tester and an appropriate load cell are employed for the testing. The load cell is chosen (e.g. 10N) so that the test value falls within 10-90% of the full scale load. A suitable tensile tester is a MTS SYNERGY 200 tensile tester, and the tensile tester and appropriate load cell are available from MTS Systems Corporation, a business having offices located in Eden Prairie, Mich., U.S.A. Alternatively, substantially equivalent equipment may be employed. The fiber specimens in the frame assembly are then mounted between the grips 98 of the tensile tester such that the ends of the fibers are operatively held by the grips of the tensile tester. Then, the sides of the paper frame that extend parallel to the fiber length are cut or otherwise separated (e.g. along appointed cut lines 95) so that the tensile tester applies the test force only to the fibers. The fibers are then subjected to a pull test at a pull rate and grip speed of 12 inch/min. The resulting data can be analyzed using a TESTWORKS 4 software program from the MTS Corporation with the following test settings:

| Calculation Inputs Name | Value | Test Inputs Name | Value |
|---|---|---|---|
| Break Marker Drop | 50% | Break Sensitivity | 90% |
| Break Marker Elongation | 0.1 in | Break Threshold | 10 gf |
| Nominal Gage Length | 1 in | Data Acq. Rate | 10 Hz |
| Slack Pre-Load | 1 lbf | Danier Length | 9000 m |
| Slope Segment Length | 20% | density | 1.25 g/cm^3 |
| Yield Offset | 0.20% | Initial Speed | 12 in/min |
| Yield Segment Length | 2% | Secondary Speed | 2 in/min |

The tenacity values can be expressed in terms of dynes per denier, or gram-force per denier. The fiber elongation can be expressed in terms of percent elongation (% elongation), as determined at peak load. The conduct of the tenacity test also provides data for the determination of other parameters, such as peak load, Peak Energy and denier.

With the present invention, the high tenacity fibers can be present even when fiber material has been subjected to a low value of fiber-draw (e.g. a low fiber-draw speed and/or a low draw-down ratio). In a particular configuration, the fiber material has been subjected to a fiber draw down ratio of 2000 or less. In other configurations, the high tenacity fiber can be present even when the fiber material has, for example, been subjected to a fiber-draw speed of 2500 m/min or less, or a fiber-draw speed of 2000 m/min or less.

An additional feature of the invention can provide fibers having a relatively high elongation-at-break value, even when the fiber material has been subjected to a low value of fiber-draw (e.g. a low fiber-draw speed and/or a low draw-down ratio). In a particular aspect, the fibers can have an elongation-at-break value of at least a minimum of about 25% relative to their initial fiber lengths. The fibers can alternatively have an elongation-at-break value of at least 35%, and can optionally have an elongation-at-break value of least about 50%. Desirably, the fibers of the invention can have an elongation-at-break value of least about 70% relative to their initial fiber lengths when fiber material has been subjected to a low value of fiber-draw.

Fibers and fibrous webs of the invention (for example, PLA fibers and PLA fibrous webs) can also have a distinctively low, thermal shrinkage value. In a particular aspect, the thermal shrinkage value of the fibers can be not more than a maximum of about 30% relative to their initial fiber lengths, even when the fiber material has been subjected to a low value of fiber-draw (e.g. a low fiber-draw speed or a low draw-down ratio). The fibers can alternatively have a thermal shrinkage value of not more than 20%, and can optionally have a thermal shrinkage value of not more than 10% to provide improved benefits. Desirably, the fibers of the invention can have a thermal shrinkage value of not more than about 5% relative to their initial fiber lengths when the fiber material has been subjected to a low value of fiber-draw.

The thermal shrinkage value of the fiber can be determined in accordance with the *Standard Test method for Shrinkage of Textile Fibers* (ASTM D5104-96). This test method pertains to the measurement of the shrinkage of crimped or uncrimped single staple fibers when exposed to hot air or other fluid heated to a temperature near the boiling point of water. A well conditioned single fiber (conditioned to current laboratory temperature and humidity) is lightly loaded between suitable clamps at a load sufficient to straighten the fiber without significant stretching, and allow a measurement of a nip-to-nip initial length of the fiber. This initial length is recorded as ($L_0$). Without being removed from the clamps, the fiber is relieved of the load and exposed to the test environment; typically water at or near its boiling point, or hot air at specified temperature for a specified length of time. A recommended test configuration is water temperature set at 98° C. or a hot air convective oven temperature set at 100° C. The specimen is heated for 15 minutes. Subsequently, the fiber is reconditioned back to the laboratory conditions of moisture and temperature equilibrium by leaving the samples in an unloaded condition in the laboratory overnight. The fiber is again lightly loaded with the clamps, and final nip-to-nip length is measured and recorded as ($L_f$). The % shrinkage is determined according to the following formula:

$$\% \text{ Shrinkage}=100*(L_0-L_f)/L_0.$$

For the selected type of fiber, at least 10 replications of length measurements are conducted, and the shrinkage values of the 10 specimens are arithmetically averaged to determine the shrinkage value of the particular type of fiber. Desirably, the standard deviation of the measurements from the 10 specimens is also reported.

The invention can provide polymer fibers having a high crystallinity value. In particular aspects, the crystallinity value can be at least a minimum of about 30%, as determined by DSC analysis. The crystallinity value can alternatively be at least about 35%, and can optionally be at least about 45% to provide desired benefits. In other aspects to provide improved effectiveness, the crystallinity value can be up to a maximum of about 70%, or more. The crystallinity value can alternatively be up to about 65%, and can optionally be up to about 55%.

If the crystallinity value is too low, fibers can exhibit excessive thermal shrinkage and low tenacity. If the crystallinity value is too high, fibers can have low elongation at break or may be too brittle and stiff.

The melting temperature, glass transition temperature and degree of crystallinity of a material can be determined by employing differential scanning calorimetry (DSC). A suitable differential scanning calorimeter for determining melting temperatures and other melting parameters can, for example, be provided by a THERMAL ANALYST 2910 Differential Scanning Calorimeter, which has been outfitted with a liquid nitrogen cooling accessory and with a THERMAL ANALYST 2200 (version 8.10) analysis software program, both of which are available from T.A. Instruments Inc., a business having offices located in New Castle, Del., U.S.A. Alternatively, a substantially equivalent DSC system may be employed.

The material samples tested can be in the form of fibers or resin pellets. It is desirable to not handle the material samples directly, but rather to use tweezers or other tools, so as not to introduce anything that would produce erroneous results. The material samples were placed into an aluminum pan and weighed to an accuracy of 0.01 mg on an analytical balance. A lid was crimped over the material sample onto the pan. Typically, the resin pellets were placed directly in the weighing pan, and the fibers were cut to accommodate placement on the weighing pan and covering by the lid.

The differential scanning calorimeter was calibrated using an indium metal standard and a baseline correction was performed, as described in the operating manual for the differential scanning calorimeter. A material sample was placed into the test chamber of the differential scanning calorimeter for testing, and an empty pan is used as a reference. All testing was run with a 55 cubic centimeter/minute nitrogen (industrial grade) purge on the test chamber. For testing resin pellet samples, the heating and cooling program is a 2 cycle test that begins with an equilibration of the chamber to −25° C., followed by a first heating period at a heating rate of 20° C./minute to a temperature of 200° C., followed by equilibrating the sample at 200° C. for 3 minutes, followed by a first cooling period at a cooling rate of 20° C./minute to a temperature of −25° C., followed by equilibrating the sample at −25° C. for 3 minutes, and then a second heating period at a heating rate of 20° C./minute to a temperature of 200° C. For testing fiber samples, the heating and cooling program is a single cycle test that begins with an equilibration of the chamber to −25° C., followed by a heating period at a heating rate of 20° C./minute to a temperature of 200° C., followed by equilibrating the sample at 200° C. for 3 minutes, followed by a cooling period at a cooling rate of 20° C./minute to a temperature of −25° C. All testing was run with a 55 $cm^3$/minute nitrogen (industrial grade) purge on the test chamber.

The results were evaluated using the THERMAL ANALYST 2200 analysis software program, which identified and quantified the glass transition temperature (Tg) of inflection, the endothermic and exothermic peaks, and the areas under the peaks on the DSC plots. The glass transition temperature was identified as the region on the plot-line where a distinct change in slope occurs, and the melting temperature was determined using an automatic inflection calculation. The areas under the peaks on the DSC plots were determined in terms of joules per gram of sample (J/g). For example, the endothermic heat of melting of a resin or fiber sample was determined by integrating the area of the endothermic peak. The area values are determined by converting the areas under the DSC plots (e.g. the area of the endotherm) into the units of joules per gram (J/g) by use of computer software.

The Crystallinity Percent of a resin or fiber sample can be calculated as follows:

$$\text{Percent crystallinity}=100*(A-B)/C$$

where:

A=Sum of endothermic peak areas, J/g;

B=Sum of exothermic peak areas, J/g;

C=Endothermic heat of melting value for the selected polymer where such polymer has 100 percent crystallinity, J/g.

For polylactic acid polymer, C=93.7 J/g {Ref. Cooper-White, J. J., and Mackay, M. E., *Journal of Polymer Science*, Polymer Physics Edition, p. 1806, Vol. 37, (1999)}. The areas under any exothermic peaks that are encountered in the DSC scan due to insufficient crystallinity are subtracted from the area under the endothermic peak to appropriately represent the degree of crystallinity.

Where the fiber material has been provided in accordance with the invention and the fiber material has been subjected to a relatively low value of fiber-draw (e.g. a low fiber-draw speed and/or a low draw down ratio), the fiber material can exhibit a distinctive DSC melting endotherm. In a particular feature, the melting endotherm of PLA fiber material can exhibit a melting enthalpy of at least a minimum of about 40 joule/gram. The melting endotherm can alternatively exhibit a melting enthalpy of at least about 50 J/g, and can optionally exhibit a melting enthalpy of at least about 55 J/g, or more, to provide improved performance. If the DSC melting endotherm exhibits a melting enthalpy outside the desired values, the fibers may not have a sufficiently high level of crystallinity, and may exhibit an excessively low value of fiber tenacity. Additionally, the fibers may exhibit an excessively high level of fiber shrinkage when the fiber is exposed to temperatures above the glass transition temperature of the fiber material.

The fiber material of the invention can also exhibit a distinctive DSC crystallization exotherm. In a particular aspect, the DSC exotherm can be positioned above the glass transition temperature. In another aspect, the DSC exotherm can exhibit a crystallization enthalpy of not more than maximum of about 15 joule/gram (J/g). The DSC crystallization exotherm can alternatively exhibit a crystallization enthalpy of not more than about 10 joule/gram, and can optionally exhibit a DSC crystallization enthalpy of not more than about 5 joule/gram. In a further aspect, the DSC crystallization enthalpy can be not more than about 3 joule/gram to provide improved benefits. If the DSC crystallization exotherm exhibits a crystallization enthalpy outside the desired values, a significant amount of crystallization may occur above the glass transition temperature, and the fibers can exhibit excessively high levels of fiber shrinkage and excessively low levels of heat stability.

In a further feature, the fiber material of the invention can exhibit a DSC melting peak endotherm, which has a distinctive width-value, and the melting peak endotherm can have a total width-value determined at a half-peak height of the melting peak endotherm. In a particular aspect, of PLA fiber material the width-value can be of at least a minimum of about 7° C. The endotherm width value can alternatively be at least about 9° C., or more, and can optionally be at least about 11° C. or more to provide improved effectiveness.

The fiber material of the invention can also exhibit a DSC melting endotherm that includes the presence of double peaks. The double peaks can represent a combination of crystalline forms present in the solidified fiber material. As representatively shown (e.g. FIG. 15), the fiber material can include a first crystalline form and at least a second crystalline form. The first crystalline form can be relatively more stable and can have a relatively higher melting temperature. The second crystalline form can be relatively less stable and can have a relatively lower melting point. Where the fiber material includes a PLA polymer, for example, the first crystalline form can exhibit a DSC melting endotherm peak which occurs at approximately 168° C.-170° C. Additionally, the second crystalline form of the PLA polymer can exhibit a melting endotherm peak that occurs within the range of about 163° C.-165° C.

A further feature of the invention can provide a fibrous nonwoven web or fabric having desired, grab tensile strength values along the machine-direction 22 of the fibrous web 60. In particular aspects, the MD grab tensile strength can be at least a minimum of about 17.8 N (about 4 pounds force). The MD grab tensile strength can alternatively be at least about 35.6 N (about 8 pounds force), and can optionally be at least about 44.5 N (about 10 pounds force) to provide desired benefits. In other aspects, the MD grab tensile strength can be up to a maximum of about 111 N (about 25 pounds force), or more. The MD grab tensile strength can alternatively be up to about 89 N (about 20 pounds force), and can optionally be up to about 71.2 N (about 16 pounds force) to provide improved effectiveness.

A further feature of the invention can provide a fibrous nonwoven web or fabric having desired, grab tensile strength values along the cross-direction 24 of the fibrous web 60. In particular aspects, the CD grab tensile strength can be at least a minimum of about 8.90 N (about 2 pounds force). The CD grab tensile strength can alternatively be at least about 13.3 N (about 3 pounds force), and can optionally be at least about 17.8 N (about 4 pounds force) to provide [improved] desired benefits. In other aspects, the CD grab tensile strength can be up to a maximum of about 66.7 N (about 15 pounds force), or more. The CD grab tensile strength can alternatively be up to about 53.3 N (about 12 pounds force), and can optionally be up to about 44.5 N (about 10 lbs pounds force) to provide improved effectiveness. If the MD or CD grab tensile strengths are outside the desired values, the fabric can be excessively susceptible to undesired tearing during processing or during use.

The grab tensile strength values can be determined in accordance with the following test procedure, which is based on ASTM Standard D-5034. A nonwoven fabric sample is cut or otherwise provided with size dimensions that measure 102 mm wide by 152 mm long. A constant-rate-of-extension type of tensile tester is employed. A suitable tensile testing system is a MTS SYNERGY 200 Tensile Tester, which is available from MTS Systems Corporation, a business having offices located in Eden Prairie, Mich., U.S.A. The tensile tester can be equipped with TESTWORKS 4.08B software from MTS Corporation to support the testing. Substantially equivalent equipment and software may alternatively be employed. An appropriate load cell is selected such that the tested value will fall within the range of 10-90% of the full scale load. The 102 mm wide by 152 mm long sample is held between grips having a front face measuring 25.4 mm×25.4 mm and a back face measuring 25.4 mm×51 mm. The grip faces are rubberized, and the longer dimension of the grip is perpendicular to the direction of pull. The tensile test is run at 300 mm per minute rate with a gage length of 76 mm and a break sensitivity of 40%.

Three fabric specimens are tested by applying the test load along the machine-direction of the fabric, and three fabric specimens are tested by applying the test load along the cross direction of the nonwoven fabric. During the testing of each specimen, the peak load, the peak stretch which is the %-extension at peak load, and the energy to peak can also be measured. The three, peak grab tensile loads from the three specimens tested along the cross-direction of the fabric are arithmetically averaged to determine the CD grab tensile strength value of the fabric. Similarly, the three, peak grab tensile loads from the three specimens tested along the machine-direction of the fabric are arithmetically averaged to determine the MD grab tensile strength value of the fabric. The CD value is then divided by the MD value to obtain the ratio of the cross-direction tensile strength to the machine-direction tensile strength (referred as CD/MD tensile ratio). Ratios of 0.5 or higher are generally desirable for nonwoven (e.g. spunbond) fabrics.

The nonwoven fabric 60 of the invention can be configured to have more uniform or more isotropic strength properties. In a particular aspect, the article of the invention can provide a nonwoven fabric or other fibrous web having a high tensile strength quotient or ratio when comparing the peak tensile strengths of the fabric along its cross-direction and machine-direction. In a desired aspect, the CD/MD ratio can be not less than a minimum of about 0.1. The CD/MD tensile strength ratio of the nonwoven fabric can alternatively be not less than about 0.2:1 or about 0.3:1, and can optionally be not less than about 0.4 to provide desired benefits. In further arrangements, the nonwoven fabric can have a CD/MD tensile strength ratio of not less than about 0.5:1 to provide improved benefits. Desirably, the tensile strength ratio of the nonwoven fabric can be up to about 0.7:1 or 1:1.

In particular configurations of the invention, the fiber material can be formed from a base material comprising about 99.9 wt % of PLA polymer material. In other configurations of the invention, the fiber material can be formed from a base material which has been provided by admixing at least about 98 wt % of a PLA material and up to about 2 wt % of additives, such as plasticizing agents, nucleating agents or the like, as well as combinations thereof. Still other configurations of the invention can include fiber material that has been formed from a base material which has been provided by admixing at least about 95 wt % of PLA material and up to about 5 wt % of additive materials, such as plasticizing agents, and/or nucleating agents or the like, as well as combinations thereof. The PLA polymer material can desirably include other features, such as a high molecular weight in the range of a number average molecular from about 50,000 Daltons to about 200,000 Daltons. The PLA polymer material can optionally include a blend of PLA polymers or copolymers.

In a desired configuration of the invention, the method and apparatus of the invention can be employed to produce PLA fibers and nonwoven, PLA fabrics which have improved properties by distinctively addressing the slow crystallization kinetics of PLA materials. The crystallization rate of PLA is significantly lower than the crystallization rate of other conventional materials, such as polypropylene (PP). In addition, PLA efficiently crystallizes in a relatively narrow temperature window that ranges from about 95° C. to about 120° C., with a maximum crystallization rate occurring at a temperature of about 105° C. At temperatures above 120° C., the crystallization rate can drop as a result of low nucleation (nucleation controlled crystallization). At temperatures below about 95° C. and especially below about 70° C., a low level of molecular mobility can excessively constrain the crystallization process as the PLA polymer cools towards its glass transition temperature of about 62° C. The present invention includes particular resin modifications and process modifications which can enhance the crystallization of PLA during the formation of the PLA polymer fibers and during the processing of nonwoven fabrics (e.g. spunbond nonwoven fabrics) that include the fibers. Additionally, the PLA fibers and PLA fabrics can be efficiently produced while employing conventional equipment, such as conventional fiber-spinning equipment.

In a particular feature, the process of the invention can include a heating of an anneal-quench zone of the production line (e.g. spunbond production line) to a distinctive anneal-quench temperature. Desired configurations of the formed fibers and fiber filaments can be formed from a base material that includes a polylactic acid (PLA) polymer material, and the PLA material can have a prime-temperature of about 105° C. Accordingly, the anneal-quench zone can be operatively heated to an anneal-quench temperature of about 105° C. to help enhance the crystallization process of the PLA material. In a particular aspect of the invention, the PLA material can be anneal-quenched with air or other gas that is provided at an anneal-quench temperature which is at least a minimum of about 70° C. The anneal-quench temperature can alternatively be at least about 80° C., and can optionally be at least about 95° C. to provide desired benefits. In other aspects, the anneal-quench temperature can be up to a maximum of about 125° C., or more. The anneal-quench temperature can alternatively be up to about 115° C., and can optionally be up to about 110° C. to provide desired effectiveness.

An increased molecular orientation in the PLA fibers can be provided by configuring the fiber drawing unit 40 apply a fiber-draw pressure in the range of about psi to 18 psi (about 69-124 KPa). The resulting high level of fiber-draw can help induce a desired, higher level of crystallization. An optional heated-draw operation, which can concurrently and additionally subject the fiber material to a selected heated-draw temperature of about 105° C., can help enhance the crystallization rate. The heated-draw temperature can, for example, be operatively provided by employing heated air or other heated gas. Selected melt temperatures and selected geometries of the spin pack-capillaries can also help provide a higher molecular orientation in a PLA melt, and can help provide an improved, orientation-induced nucleation of the crystallizing fiber material.

The heated anneal-quench as well as the optional, heated fiber-draw can help to improve the crystallization rate and broaden the thermal window and a residence time for the crystallization of the selected fiber material. In another aspect, the invention can include a heated anneal-quench operation which incorporates a temperature gradient. A desired configuration can include a first-zone (e.g. upper zone) of an anneal-quench chamber that is heated to a first temperature, and second-zone (e.g. lower zone) of the anneal-quench chamber that is heated to a relatively lower, second anneal-quench temperature. At least one, and optionally both of the first and second anneal-quench temperatures can be with the prime-temperature range of the selected fiber polymer.

When processing a PLA fiber material, for example, the first anneal-quench temperature in the first-zone can be within the range of about 105-110° C., and the second anneal-quench temperature in the second-zone can be within the range of about 45-70° C.

In a similar manner, the heated fiber-draw operation can incorporate a temperature gradient. In a desired configuration, a first-zone (e.g. upper zone) of the fiber-draw operation can be heated to a first fiber-draw temperature, and second-zone (e.g. lower zone) of the fiber-draw operation can be heated to a relatively lower, second fiber-draw temperature. At least one, and optionally both of the first and second fiber-draw temperatures can be with the prime-temperature range of the selected fiber polymer.

When processing a PLA fiber material, for example, the first fiber-draw temperature can be within the range of about 105-110° C., and the second fiber-draw temperature can be within the range of about 45-70° C. The temperature gradient can allow a more efficient fiber-drawing operation, and can allow a more efficient crystallization of the fiber material in the heated, anneal-quench chamber.

In the various configurations of the invention, the heated fiber-draw can more effectively provide a draw-induced molecular orientation and can facilitate a desired crystallization process in the fiber material. The heated anneal-quench and the optional heated fiber-draw can enable the formation of more stable fibers and fabrics, and the fibers and fabrics can exhibit lower shrinkage. The fibers and fabrics can also exhibit improved tenacity and improved tensile properties. Additionally, the polymer fibers can be produced at distinctively low fiber velocities of about 2500 m/min or less. In desired configurations, the polymer fibers can be produced at low fiber velocities of about 2000 m/min or less. The low fiber velocities can help provide an improved formation of the fabric web, and can help provide more balanced web tensile properties in the fabric webs. For example, PLA nonwoven fabrics can exhibit better web formation and more balanced tensile properties, as compared to commercially available PLA spunbond webs.

Figure 15:
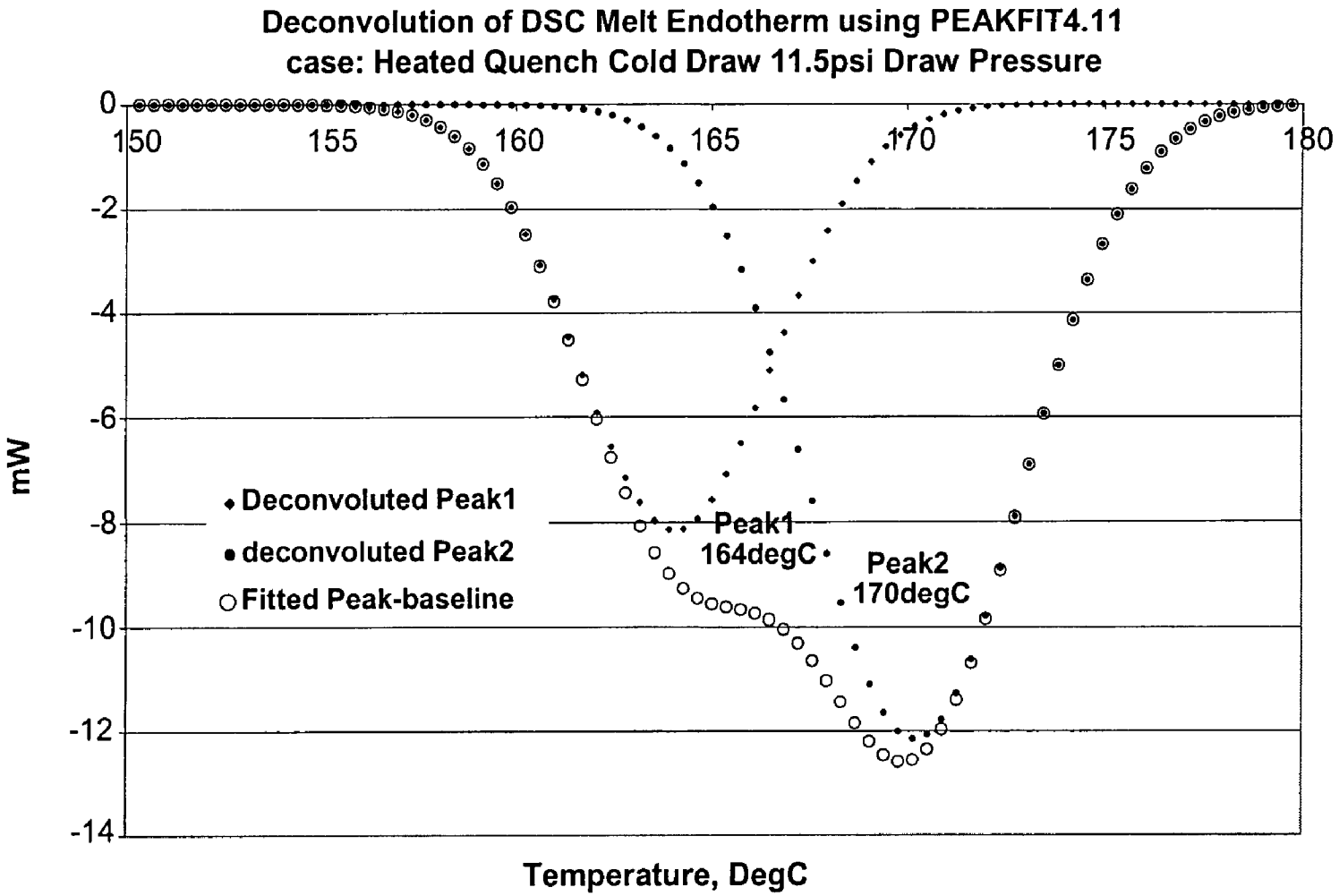
FIG. 15 shows a graphical plot of a representative DSC melt endotherm, and also showing the melt endotherm deconvoluted into its two constituent peaks.

As can be observed from corresponding DSC scans, the fiber material in the present invention can exhibit "negative" peaks in the melt endotherm, and the melt-peaks can become distinctively wider when the fiber-draw has been conducted (e.g. see the data column in the data tables that pertain to the peak-width measured at the half-peak height of the melt endotherm). Additionally, the effect of the fiber-draw was more pronounced when the anneal-quench air was heated to about 212° F. (100° C.). Furthermore, when the temperature of the applied draw air was also heated up to about 212° F. (100° C.), the peak widening effect can be further increased (e.g. see FIG. 12, FIG. 16, and Table 7 of FIG. 17). With reference to FIG. 15, one can observe how the melt endotherm can include two or more peaks, such as the two constituent peaks, which occur at approximately the 163.5° C. and 169.5° C. locations in the melt endotherm. The wider melt-peak of the fiber material can be beneficial by providing a wider thermal operating window that can provide for a more robust bonding of the fibers and fabrics at high bonding speeds. In contrast, an excessively narrow thermal operating window can result in frequent bonding roll wrap-ups (e.g. from over bonding). Attempts to avoid the wrap-ups can undesirably produce an under-bonding of the fibers and fabrics.

In prior conventional techniques, polymers of two or more different grades have been mixed or arranged in a sheath-core configuration to provide a fiber material having a wider operating thermal window. When compared to the present invention, however, the prior techniques have been more complex, more expensive, and less efficient.

The article of the invention can be configured to provide a personal care product, such as an infant diaper, children's training pants, a feminine hygiene product (e.g. a sanitary napkin, feminine care pad, or pantiliner), an adult incontinence product, an item of protective outerwear, or a protective cover.

Figure 19:
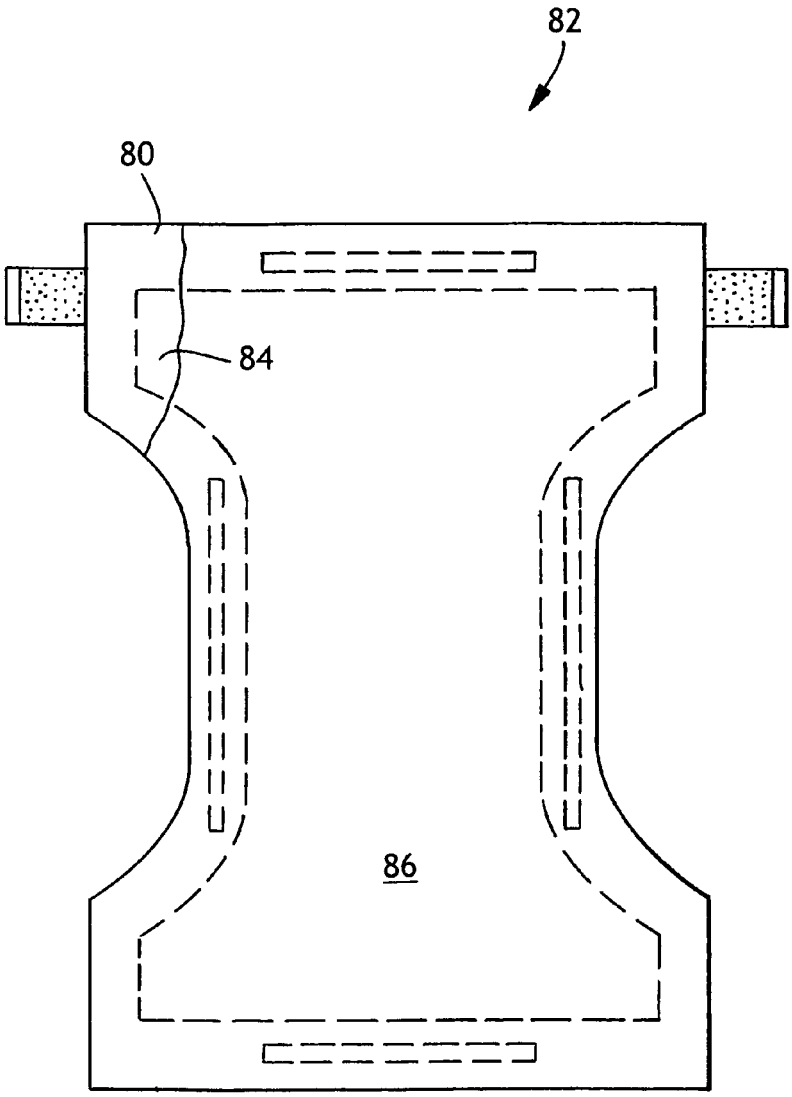
FIG. 19 shows a representative personal care product.
Figure 19A:
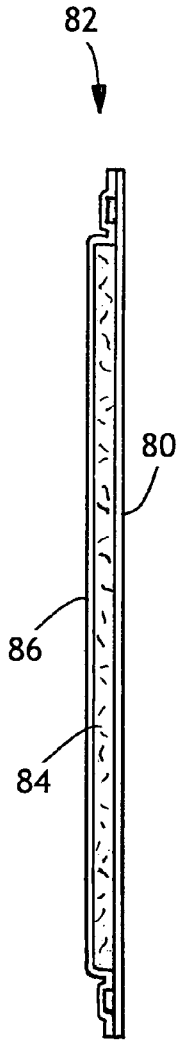
FIG. 19A shows a representative cross-sectional view of a personal care product.
Figure 20:
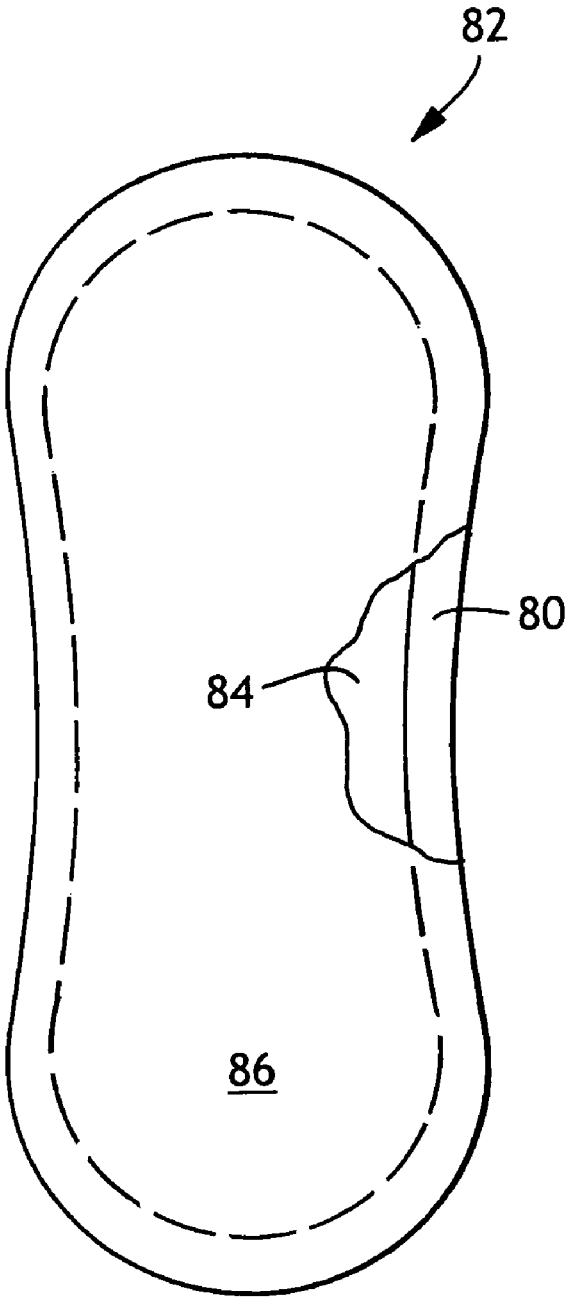
FIG. 20 shows another representative personal care product.
Figure 20A:
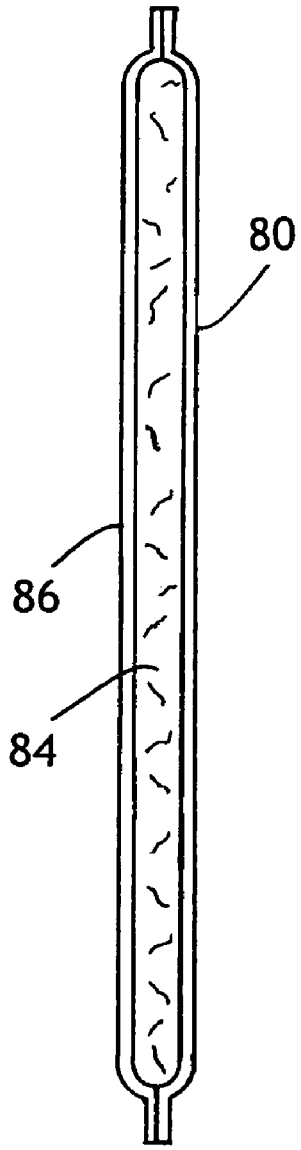
FIG. 20A shows a representative cross-sectional view of another personal care product.

With reference to FIGS. 19 through 20A, the article can further include a backsheet layer 80 which is operatively connected to a layer of the fibrous web 60 and configured with the fibrous web layer of the invention to thereby provide a personal care product 82. In particular arrangements, the backsheet layer can be configured to be operatively liquid-impermeable. In another aspect, the article and the personal care product 82 can further include an absorbent body 84 that is operatively held between the layer of the fibrous web 60 and the backsheet layer 80. The article and the personal care product 82 may further include a liquid-permeable topsheet layer 86. The layer of the fibrous web 60 can then be operatively held or otherwise operatively positioned between the topsheet layer and the backsheet layer 80; and the absorbent body 84 can be operatively held or otherwise operatively positioned between the fibrous web layer of the invention and the backsheet layer 80. Optionally, the fibrous web layer may be operatively held or positioned between the absorbent body 84 and the backsheet layer 80.

The following examples are given to provide a more detailed understanding of the invention. The particular materials, dimensions, amounts and other parameters are exemplary, and are not intended to specifically limit the scope of the invention.

EXAMPLES

A main objective of drawing and stretching the fibers is to increase the molecular orientation and crystallinity of the polymer in the fiber. The increased crystallinity can increase the strength and heat stability of the fibers. It should be noted that conventional spunbond processes ordinarily quench and draw the spunbond fibers by employing ambient-temperature air or cold-air. For a more effective formation of desired PLA polymer based materials (e.g. spunbond fibers and fabrics), a particular aspect of the invention can replace the conventional quenching operation by a distinctive heated air (e.g. 70-110° C.) anneal-quench. The anneal-quench can provide an increased level of crystallinity at a given pressure of the process-air employed to pneumatically pull and plastically stretch the forming polymer fibers.

The heated anneal-quench (e.g. with hot air) can help produce higher levels of crystallization, lower shrinkage and better heat stability. In another aspect, the crystallinity can be further increased by supplementing the hot-air anneal-quench operation with a hot-air heated-draw operation. As a result, lower draw pressures are needed to attain desired levels of crystallinity. The lower draw pressures can reduce air handling issues and increase the randomness of the fiber orientations on the forming wire. The increased randomness of the deposited fibers can help provide more isotropic properties, such as more isotropic tensile properties.

The melt endotherms obtained from corresponding DSC scans showed wider peaks with higher levels of fiber-draw. The peak widths were distinctively higher when employing a heated anneal-quench and/or a heated fiber-draw. The wider peaks of the melt endotherm indicate that the spun fibers can be more efficiently and more effectively bonded with ordinary thermal bonding techniques.

Accordingly, the invention can provide fibers and nonwoven fabrics having enhanced crystallization and melt endotherms with wider peaks, as compared to similar fibers and fabrics provided by ordinary methods, such as methods that employ cold-quench and cold draw. By conducting DSC scans and DSC curve deconvolution analyses of fibers produced at different quench temperatures (hot or cold), different draw temperatures (hot or cold) and different draw pressures, one can observe that under increasing levels of fiber-draw, the unimodal melt endotherm can gradually become bimodal (e.g. FIG. 15). One can further observe that the bimodality can increase with greater draw-pressures. It can also be observed that with a heated anneal-quench and a heated-draw, whether employed together or separately, the onset of the bimodality can be moved to lower draw pressures (e.g. FIGS. 16, 17).

With PLA fibers, for example, the bimodal melt endotherm peak can include two constituent peaks; one at about 164° C. and the other at about 170° C. (e.g. FIG. 12). It was identified that the 164° C. peak was generated by the fiber-draw operation, and the 170° C. peak was more intrinsic to thermal signature of the PLA. A gradual increase in the height/size of the 164° C. peak was noticed with increasing draw pressure. At a particular draw pressure, this peak was of larger area when either or both of a heated anneal-quench and a heated fiber-draw were employed, as shown in Table 7 of FIG. 17. A gradual decrease in the height/size of the 170° C. peak was noticed when a heated anneal-quench or a heated fiber-draw was employed or when both were employed (e.g. FIG. 17).

In the following examples, polymer fibers and nonwoven fabric webs were made by employing a spunbond process to form the fibers and deposit the fibers onto a moving, foraminous forming surface (e.g. a forming-wire belt). A BIOMER L9000 polylactic acid polymer material supplied by Biomer Inc. of Germany was utilized for fiber spinning. In addition, a lower molecular weight BIOMER 1000 polylactic acid polymer material (from Biomer Inc.) was used as a plasticizing additive to reduce the melt viscosity during the fiber spinning operation.

The Biomer L9000 PLA had the batch details of U166/04/2701; and had a MWn=113,500, and a MWw=150,700 at a polydispersivity of 1.33. MWn is the number-average molecular weight, and MWw is the weight-average molecular weight Daltons. The polymer also had a meltflow rate (MFR-RTM6800) of 46.8 g/10 min at 230° C. and 2.16 kg/cm$^2$ of load. The PLA resin was dried for 24 hours at 175° F. (about 80° C.) in a conventional dryer, and the dried polymer was extruded at 430° F. (about 225° C.) at a rate of about 0.55 g per hole per minute using a dual extruder system (e.g. see FIG. 2). Conventional Zenith melt pumps were also set at 430° F. (about 225° C.). The fibers were formed by employing a 50 hpi (holes per inch), 0.6 mm hole diameter, 14 inch (35.6 cm) melt spin pack which was manufactured by Hills Inc., a business having offices located in Melbourne, Fla., U.S.A. The extruded fibers were cold-quenched or anneal-quenched as the fibers passed through a "quench box" located immediately below the spin pack. For cold-quenching the temperature of the air was set at 53° F. (about 12° C.). For anneal-quenching, the air temperature was set at 212° F. (100° C.). Then, the fibers were sucked into a forced draft unit by a pneumatic, venturi action which caused a drawing of the fibers, and the amount of fiber-draw was controlled by the air pressure delivered into the fiber drawing unit. During the data collection, the air pressure was varied from 2 psi to 12 psi (14-83 KPa). The temperature of the drawing air was set at 53° F. (about 12° C.) to provide a cold-quench, or was set at 212° F. (100° C.) to provide a heated anneal-quench. Generally, the higher draw-pressure caused increased levels of fiber breaks, increased roping and increased levels of other instabilities. Low melt-strengths of the polymer material and unbalanced air flows, required a careful control of the fiber forming process. A nonwoven web was obtained by drawing an operative vacuum under the moving forming wire, which was driven on a conveyor and was placed underneath the fiber drawing unit (FDU). The speed of the moving forming wire determined the basis weight of the spunbond nonwoven fabric. A heated air knife (HAK) was set at 250° F. (about 120° C.) and placed above the nonwoven fabric web to operatively impart some added tensile strength so that the web could be more readily received into a calendar or hot air bonder, as desired. In the examples, the fabric web was bonded by passing the web through a system of heated calender rolls having selected bonding patterns. The bonding rolls were set at a temperature of about 308 to 310° F. (about 153-155° C.), which was proximate the melting point of the polymer fibers in the fabric web.

Example 1

PLA nonwovens were obtained by setting the cold-quench air temperature at 53° F. (about 12° C.) and varying the FDU pressures from 3, 4, 5, 6, 8 and 10 psi (21, 28, 35, 42, 56 and 70 KPa, respectively). Pressures above 10 psi (70 KPa) generated excessive fiber breaks and process instability. Samples of fiber were collected before the hot air knife, and related data are set forth in Table 1 of FIG. 3. The data in Table 1 were generated employing the following conditions:

HILLS spin pack, 50 hpi (holes per inch), 0.6 mm hole diameter, 14 inch wide pack;
60 inch (152 cm) quench zone;
spin pack temperature=430° F. (about 225° C.);
throughput=0.55 ghm (grams per hole per minute);
hot air knife (pre-bond)=250° F. (about 120° C.).

Figure 10:
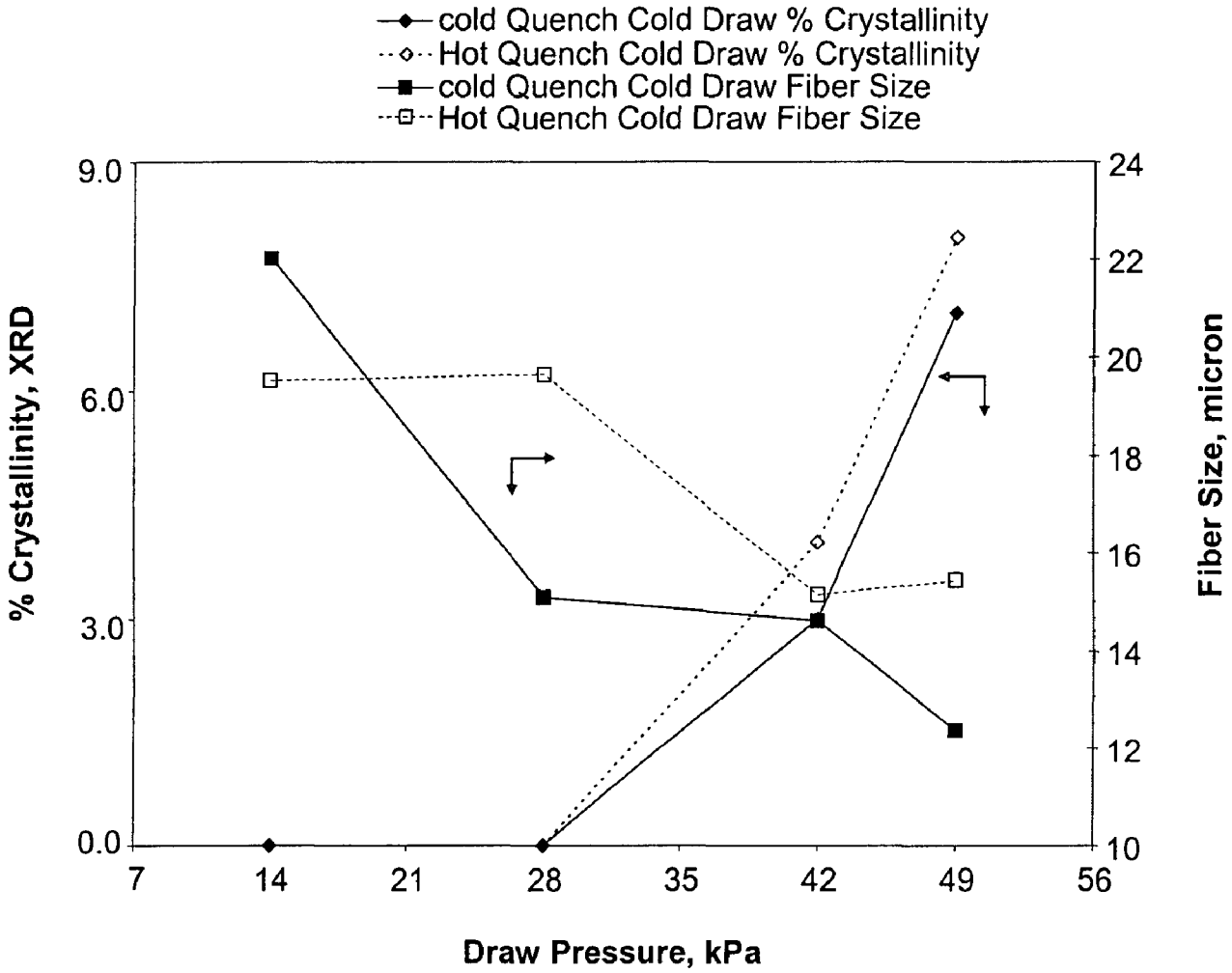
FIG. 10 shows a representative graph of the effect of the quench temperature on the crystallinity and size of fibers when the fibers are subjected to a cold temperature, fiber-draw operation.
Figure 12:
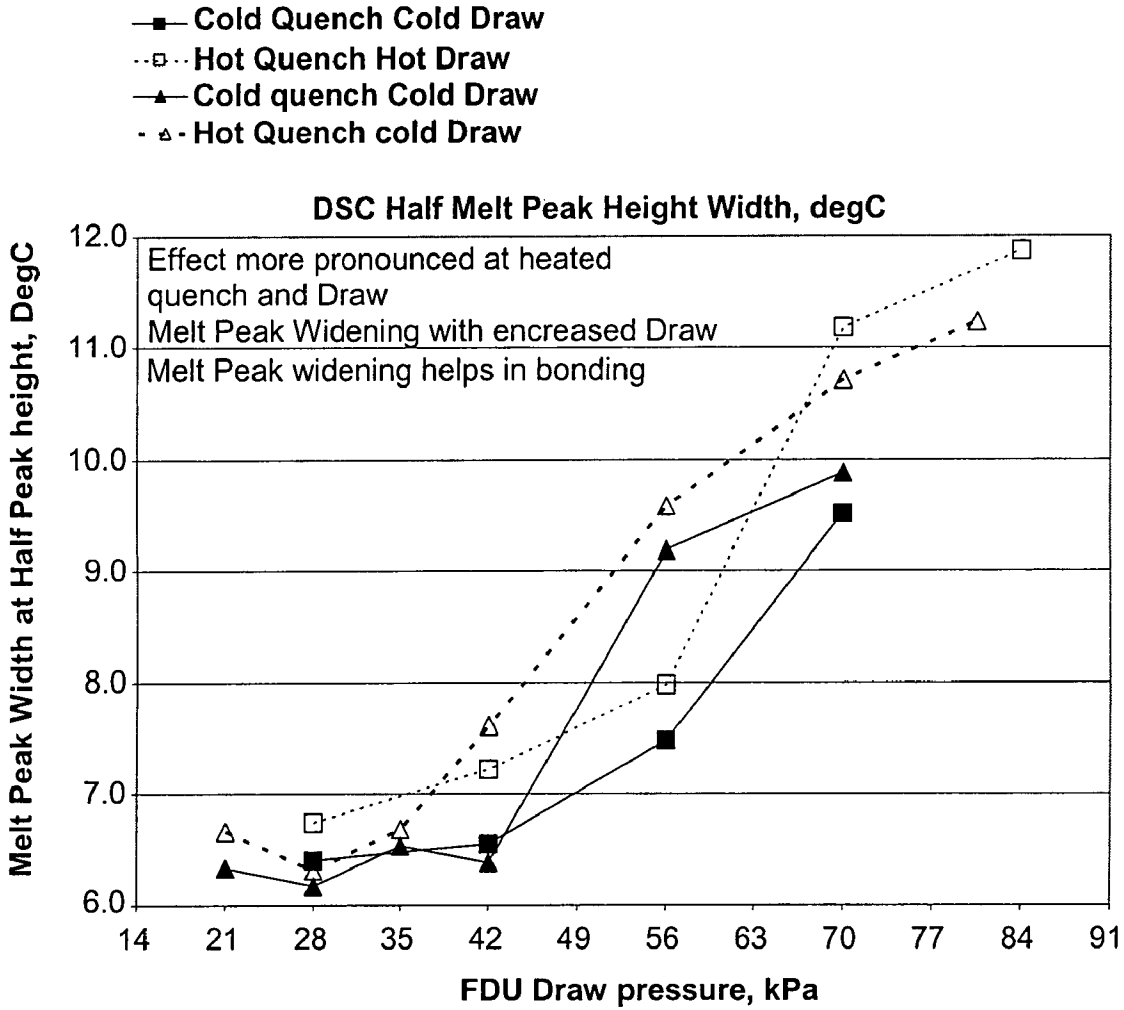
FIG. 12 shows a representative plot of the peak-width of a DSC melt endotherm as a function of the fiber-draw pressure

Data pertaining to the effect of quench temperature on crystallinity and size (microns, μm) of the PLA fibers are shown in FIG. 10. Data pertaining to the effect of cold-quench and cold-draw temperature on the crystallinity and size (micrometer) of the PLA fibers are shown in FIG. 12.

Example 2

PLA nonwovens were obtained by setting the anneal-quench air temperature at 212° F. (100° C.) and varying the FDU pressures from 3, 4, 5, 6, 8, 10 and 11.5 psi (21, 28, 35, 42, 56, 70 and 80 KPa, respectively). Samples of fiber were collected before the HAK, and related data are shown in Table 2 of FIG. 4. The data in Table 2 were generated employing the same conditions as in Example 1. Data pertaining to the effect of quench temperature on crystallinity and size (micrometer) of the PLA fibers are shown in FIG. 10. Data regarding the effect of anneal-quench and heated draw temperature on the crystallinity and size (micrometer) of the PLA fibers are shown in FIG. 12. It can be seen that the heated anneal-quench and the heated-draw resulted in a higher degree of crystallinity at a given draw pressure.

Example 3

PLA nonwovens were obtained by setting the anneal-quench air temperature at 212° F. (about 100° C.) and varying the FDU pressures from 6, 8, 10 and 11.5 psi (42, 56, 70 and 80 KPa, respectively). Samples of nonwoven spunbond were collected by running the bonder at 308-310° F. (about 153-155° C.) at a speed of around 300 feet per minute (92 m/min). Bonded nonwoven samples were thus obtained and evaluated for tensile and fluid handling properties. Samples produced at or below a 6 psi (42 KPa) FDU pressure became heavily shrunk upon bonding, and had a distinct rough feel. Materials produced with FDU pressures above 6 psi (42 KPa) exhibited a progressively smoother feel, with less shrinkage. BIOMER L9000 resin was processed at 430° F. (about 225° C.) and 0.55 ghm. A polypropylene control material, manufactured at the same facility at a 450° F. (about 232° C.) process temperature and a 0.5 ghm throughput is also reported. Data pertaining to this example are shown in Table 3 of FIG. 5. Table 3 also shows data pertaining to a commercial, PLA spunbond fabric available from Unitika (Osaka, Japan). The commercial PLA spunbond exhibited a lower CD/MD tensile ratio.

Example 4

A lower molecular weight PLA BIOMER L1000 was dry mixed with PLA L9000 at 5% by weight. The resin BIOMER L1000 had MWn=4200 dalton and MWw=11,400 dalton at a polydispersivity of 2.71. Nonwoven spunbond samples were obtained at forming conditions similar to those described for Example 3. These samples were tested for tensile and fluid handling properties. Samples produced at or below 6 psi (42 KPa) FDU pressure were heavily shrunk and had a distinct rough feel. Materials produced with FDU pressures above 6 psi (42 KPa) exhibited a progressively smoother feel with less shrinkage. Related data are shown in Table 4 of FIG. 6. The data in Table 4 were generated while employing the same conditions as in Example 1.

Example 5

A lower molecular weight PLA BIOMER L1000 was dry mixed with PLA L9000 at 5% by weight. PLA fibers were obtained by setting the anneal-quench air temperature at 212° F. (100° C.) and varying the FDU pressures from 3, 4, 5, 6, 8, 10 and 11.5 psi (21, 28, 35, 42, 56, 70 and 80 KPa, respectively). Samples of fiber were collected before the hot air knife (HAK). The extruder back pressures were reduced by as much as 30% and there was no significant loss of fiber tenacity. The visual web shrinkage measured on the moving conveyor across the hot air knife was higher in this case than 100% BIOMER L9000. The related data shown in Table 3 of FIG. 5 were generated while employing the following conditions:

HILLS spin pack, 100 hpi (holes per inch), 0.6 mm hole diameter, 14" wide pack;
60 inch (152 cm) quench zone;
spin pack temperature=430° F. (about 225° C.);
throughput=0.41 ghm (grams per hole per minute);
hot air knife (pre-bond)=250° F. (about 120° C.).

Example 6

Example 6 employed a 14 inch (35.6 cm) HILLS spin pack with 100 hpi and 0.6 mm hole diameter which was operated at a throughput of 0.41 g per hole per minute. PLA nonwovens were obtained by setting the quench air temperature at 53° F. (about 12° C.) and setting the FDU pressures at 2, 4, 6 and 7 psi (14, 28, 42 and 49 KPa, respectively). Pressures above 7 psi exhibited excessive breaks and instability. Samples of fiber were collected before the hot air knife. Data pertaining to this example are shown in Table 5 of FIG. 7. Data pertaining to the effect of quench temperature on the crystallinity and size (micrometer) of the PLA fibers are shown FIG. 11.

Example 7

Figure 11:
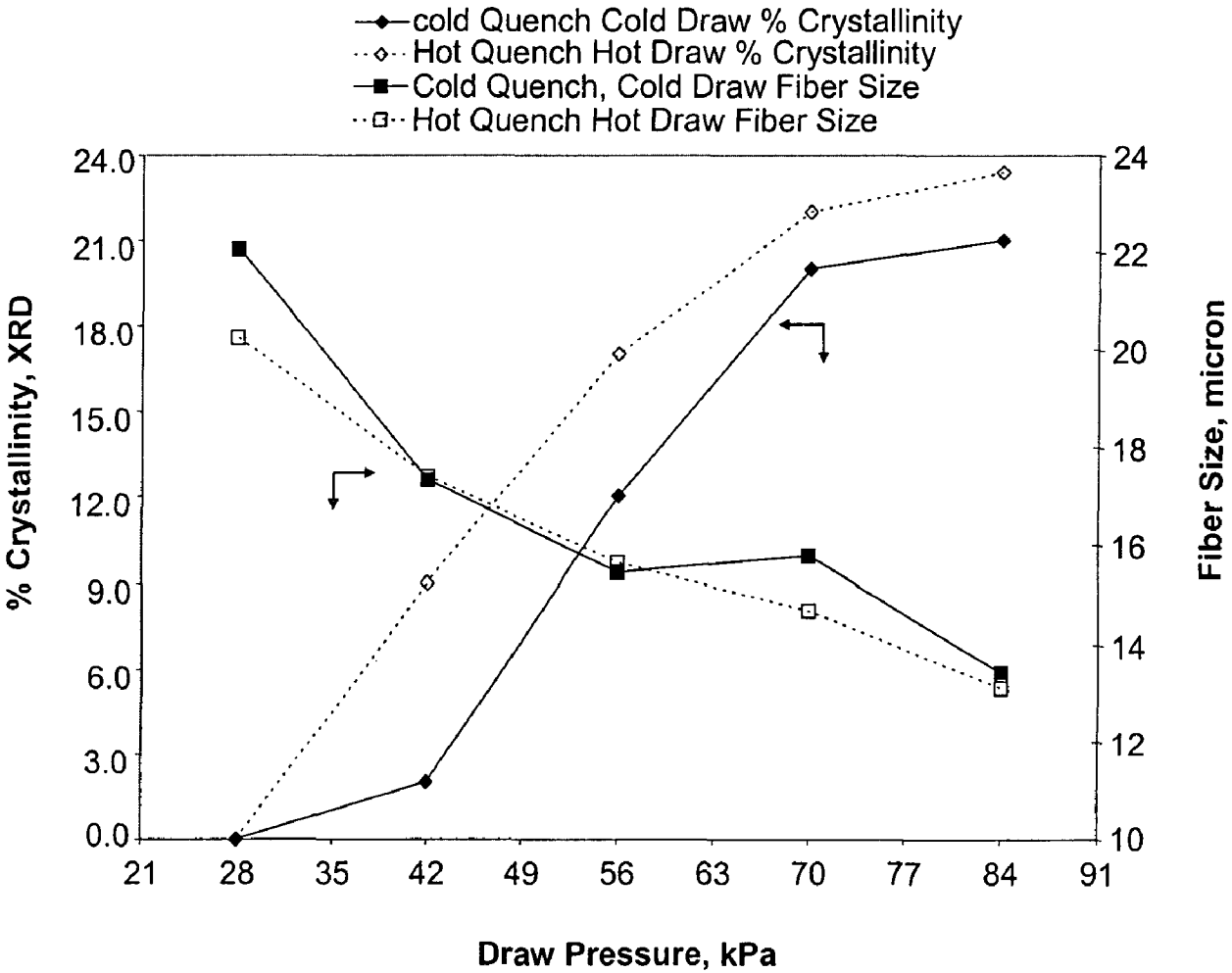
FIG. 11 shows a representative graph of the effect of the quench and draw temperatures on crystallinity and size of fibers provided by the invention.

Example 7 was similar to Example 6 by using the same hardware, but differed by using a heated anneal-quench. The equipment hardware included a 14 inch (35.6 cm) HILLS spin pack with 100 hpi and 0.6 mm hole diameter, which was operated at a throughput of 0.41 g per hole per minute. PLA nonwovens were obtained by setting the anneal-quench air temperature at 212° F. (100° C.) and setting the FDU pressures at 2, 4, 6 and 7 psi (14, 28, 42 and 49 KPa). Pressures above 7 psi (49 KPa) produced excessive breaks and process instability. Samples of fiber were collected before the hot air knife, and related data are shown in Table 5 of FIG. 7. Graphical data pertaining to the effect of quench temperature on the crystallinity and size (micrometer) of the PLA fibers are shown in FIG. 11.

Example 8

This example employed a core-sheath spin pack (e.g. KASEN spin pack available from Kasen Nozzle Mfg. Co., Ltd., a business having offices located in Osaka, Japan). The spin pack had 100 hpi, with 0.6 mm hole diameter. At a throughput of 0.4 ghm, PLA nonwovens were obtained by setting the quench air temperature at 53° F. and the draw air temperature at 53° F. (about 12° C.). The FDU pressure was varied from 4, 6, 8, 10 and 12 psi (28, 42, 56, 70 and 82 KPa, respectively). Samples of fiber were collected before the hot air knife, and related data are shown in Table 6 of FIG. 8. The data in Table 6 were obtained by employing the following:

14 inch (35.6 cm) KASEN spin pack with 100 hpi and 0.6 mm hole diameter; anneal-quench zone with a 60 inch (152 cm) extruder and spin pack temperature=430° F. (about 225° C.); throughput=0.55 ghm; hot air knife (pre-bond)=250° F. (about 120° C.).

Example 9

Example 9 employed the same equipment hardware as Example 8, but differed by using a heated anneal-quench. The anneal-quench air temperature was set at 212° F. (100° C.) and the draw air temperature was raised to 212° F. (100° C.).

The FDU pressure was varied from 4, 6, 8, 10 and 12 psi (28, 42, 56, 70 and 82 KPa, respectively). Samples of fiber were collected before the hot air knife, and related data are shown in Table 6 of FIG. 8.

Example 10

Example 10 employed a heated anneal-quench air temperature set at 212° F. (100° C.), and a draw air temperature set to 212° F. (100° C.). The FDU pressure was set at 10 psi (70 KPa) and nonwoven samples were obtained at 360 and 430 feet per minute (110-130 m/min) at basis weights of 28 and 24 g/m$^2$. Tensile and fluid handling tests were performed on these samples.

Example 11

A commercial Unitika Spunbond 30 g/m$^2$ was subjected to DSC testing in its non-bonded areas, x-ray diffraction testing, tensile testing and liquid-intake testing. Related data are shown in Table 3 of FIG. 5 and Table 6 of FIG. 8. From the DSC it was clear that there were no two peaks or shoulders visible in the melt endotherm. This spunbond fabric had a CD/MD tensile ratio of only 0.34 (a MD/CD tensile ratio of 2.94).

Figure 9:
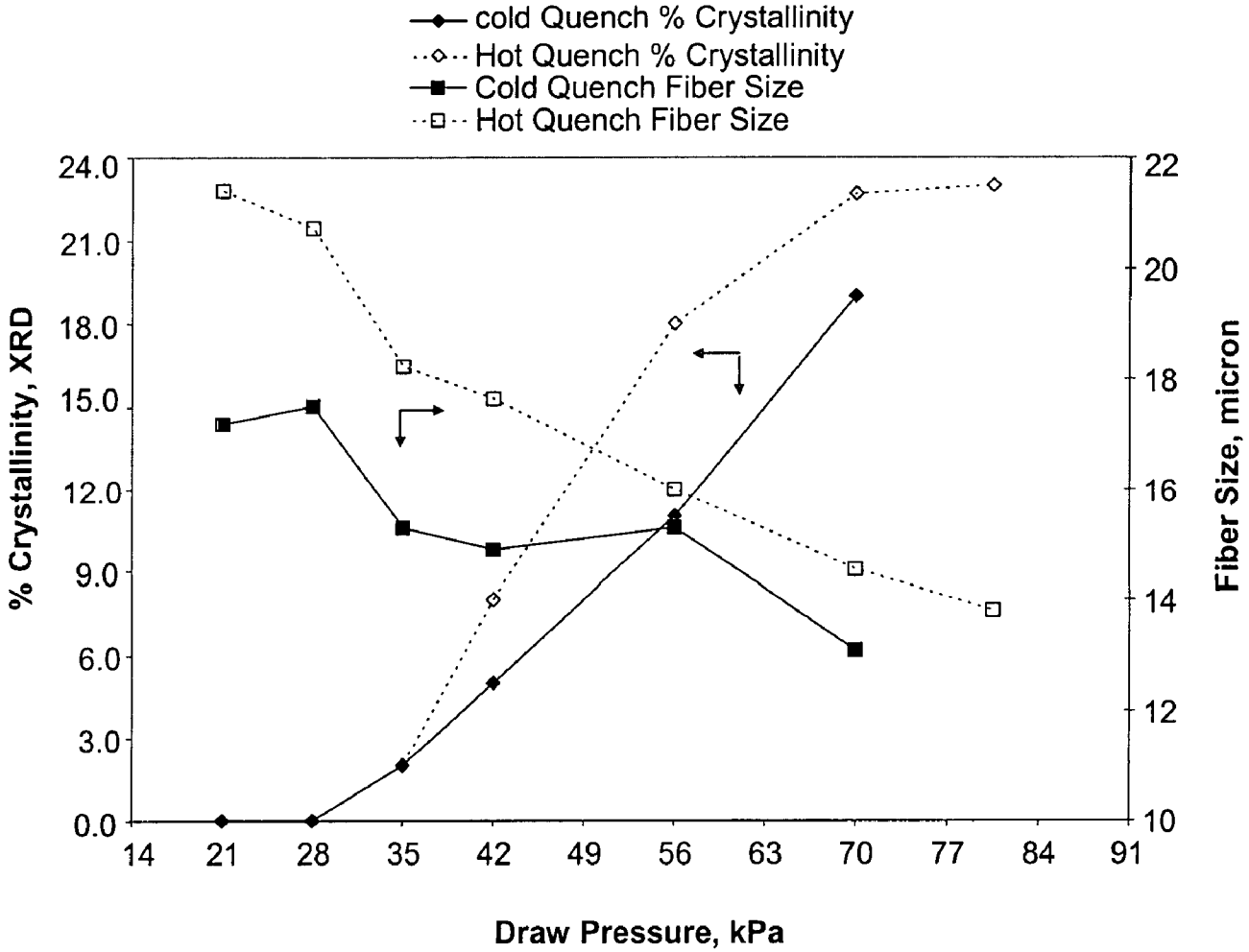
FIG. 9 shows a representative graph of the effect of the quench temperature on the crystallinity and size of fibers provided by the invention.

FIG. 9 graphically shows the effect of the quench temperature on the crystallinity and size (micrometer) of the PLA fibers. The data were obtained from Examples 1 and 2.

FIG. 10 graphically shows the effect of the quench temperature on the crystallinity and size (micrometer) of the PLA fibers when the fibers are subjected to a cold temperature, fiber-draw operation. The data were obtained from examples 6 and 7.

FIG. 11 graphically shows the effect of the quench and draw temperatures on crystallinity and size (micrometer) of the PLA fibers. The data were obtained from Examples 1 and 2. It is shown that the heated anneal-quench and the heated draw can each increase the degree of crystallinity at a given draw pressure.

FIG. 12 graphically shows a plot of the peak-width of the DSC melt endotherm versus the draw pressure, where the peak-width is measured at the half-height of the melt endotherm. The melt peaks widen at higher amounts of fiber-draw, and the widening effect is enhanced when the heated anneal-quench and heated draw are employed separately or in combination.

Figure 13:
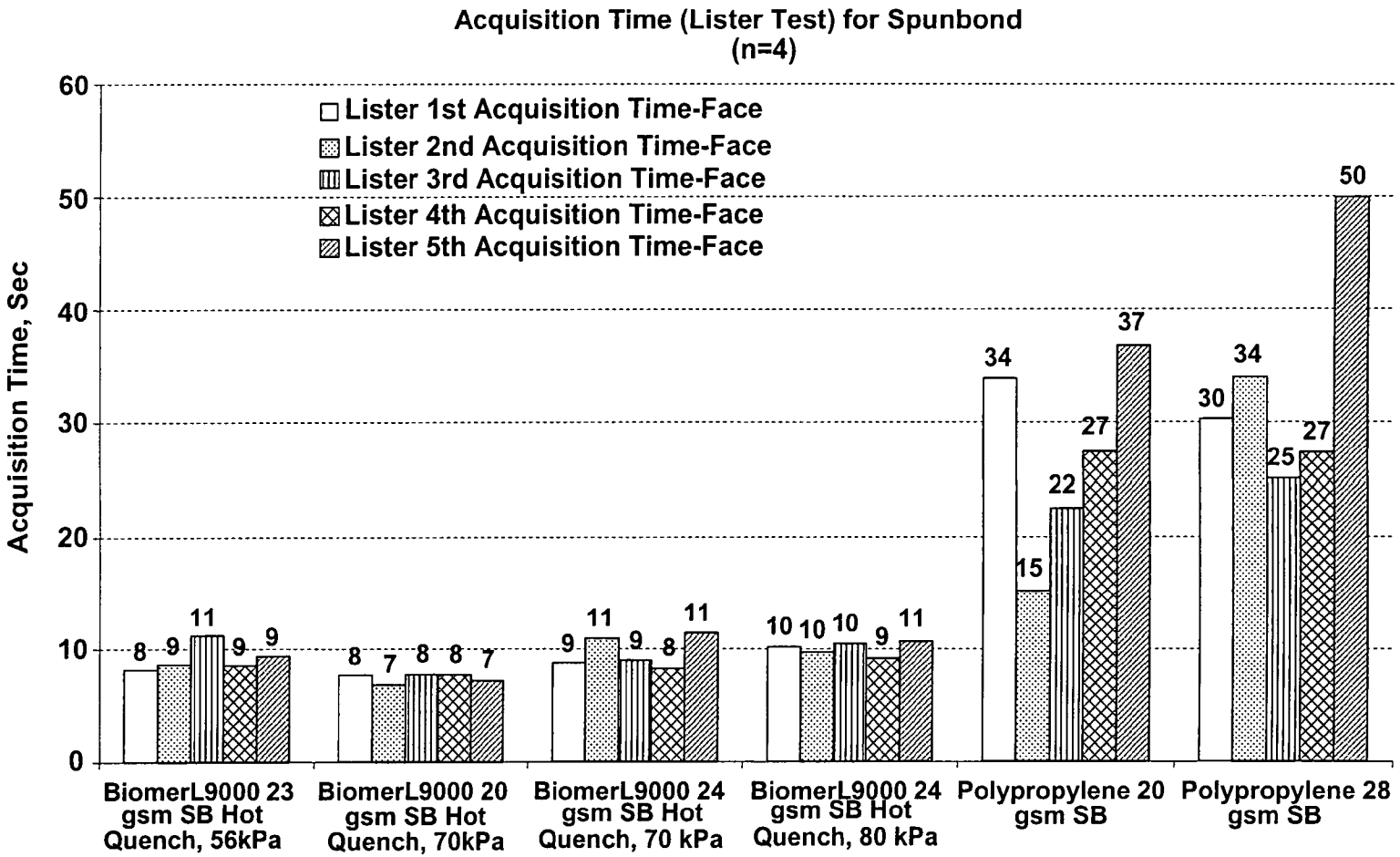
FIG. 13 shows a representative plot of five successive acquisition times for the liquid intake provided by spunbond topsheet layers that include the fibers of the invention.

FIG. 13 graphically shows a plot of five successive acquisition times (Lister test: EDANA 150.1) for the liquid intake provided by spunbond liners. Note the improved, significantly lower acquisition time exhibited by the BIOMER L9000 Spunbond topsheet layers that included fibers provided in accordance with the invention.

Figure 14:
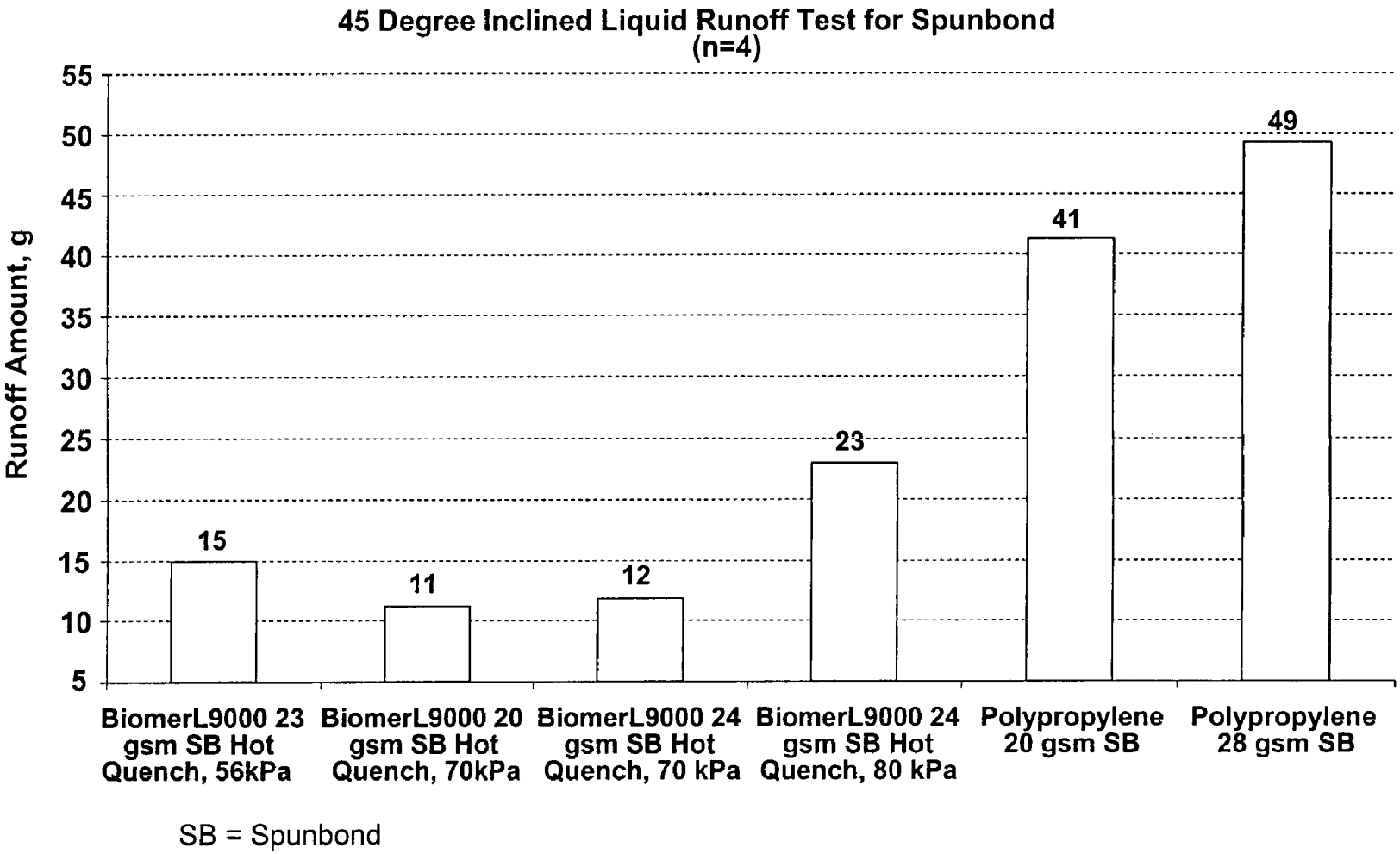
FIG. 14 shows a representative graph of data from liquid-runoff testing conducted on a spunbond fabric that included the fibers of the invention.

FIG. 14 graphically shows representative data from liquid-runoff testing in which a smaller amount of liquid to run off was exhibited by PLA BIOMER L9000 spunbond fabric materials that were provided in accordance with the invention.

FIG. 15 shows a graphical plot showing a representative DSC melt endotherm, and also showing the endotherm deconvoluted into two constituent peaks at 163.5° C. and 169° C. using PEAKFIT 4.11 software.

Figure 16:
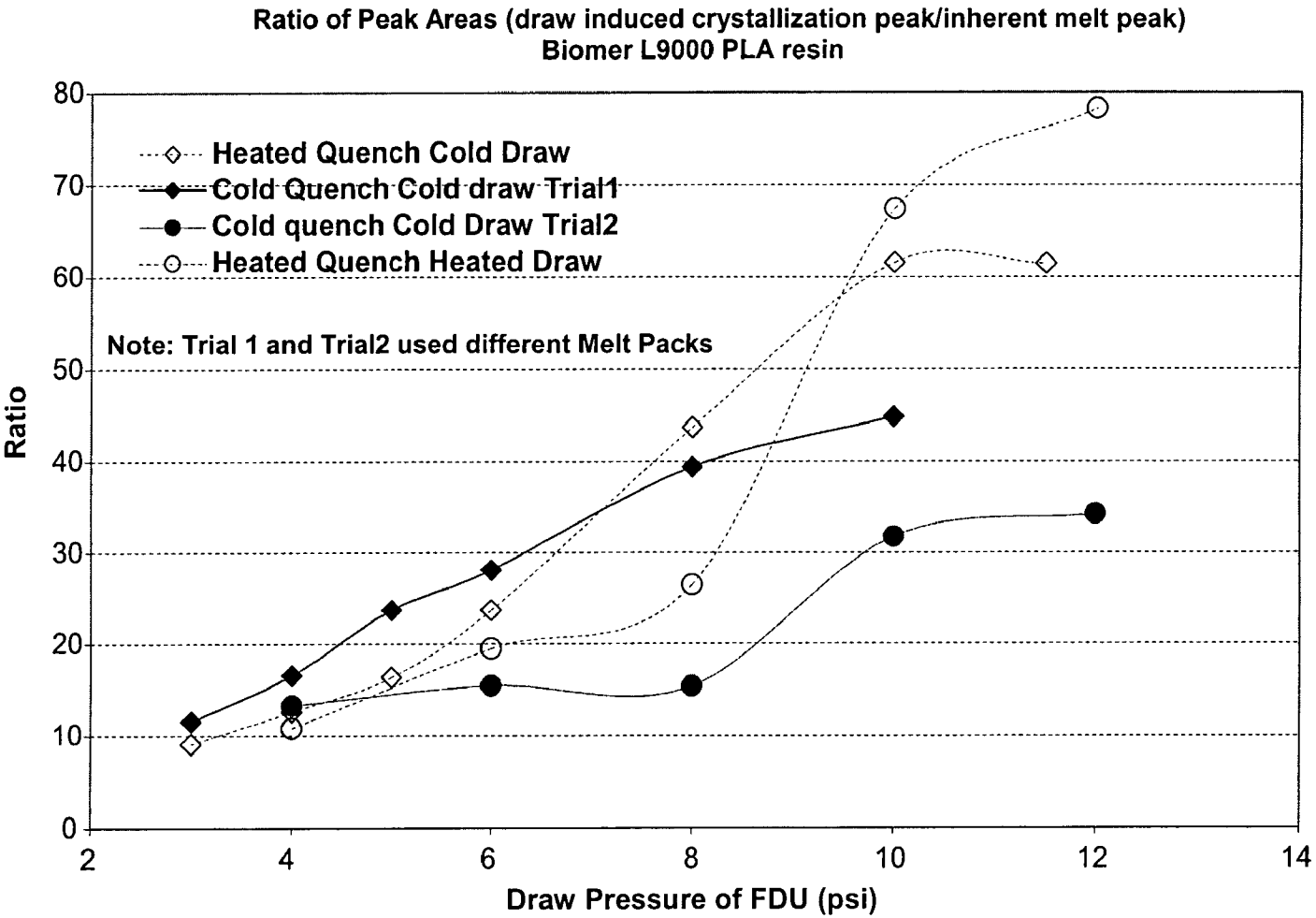
FIG. 16 shows a representative graphical plot of the ratio of the areas of the peaks (deconvoluted) observed in the DSC melt endotherm of FIG. 15.

FIG. 16 shows a graphical plot of the ratio of the areas of the peaks (deconvoluted) observed in the DSC melt endotherm. Note the high ratios provided by materials that were subjected to a heated anneal-quench and/or a heated draw at high draw pressures.

FIG. 17 shows a tabulation of peak deconvolution results from a DSC melt endotherm for PLA fibers that were obtained while employing various quench temperatures, fiber-draw temperatures, and fiber-draw pressure settings. PEAKFIT 4.11 software obtained from SYSTAT Software Inc., a business having offices located in Richmond, Calif., U.S.A., was employed to deconvolute the DSC melt endotherm into its constituent peaks.

The various tables of the present disclosure provide data pertaining to a Lister parameter determined by a Lister tester. The Lister test can be employed to determine the liquid strike-through time of a test sample of nonwoven fabric, such as the topsheet layer of a personal care product. The strike-through time is the time taken by a specified amount of liquid to be absorbed in the nonwoven fabric. This test is similar to EDANA test Number 150.9-1 (Liquid strike-through time test). A 4 inch×4 inch (10.2 cm×10.2 cm) sample of the selected nonwoven fabric material is weighed and then placed on a 4 inch×4 inch (10.2 cm×10.2 cm) assembly of 5 ply filter paper, type ERT FF3, available from Hollingsworth & Vose Company, a business having offices located at 112 Washington Street, East Walpole, Mass., U.S.A. This sample assembly is then placed under a Lister Tester. A suitable Lister tester is available from W. Fritz Mezger Inc., a business having offices located at 155 Hall Street, Spartanburg, S.C., U.S.A. A strike-through plate is employed for the testing, and is positioned over the test sample and under the Lister test equipment. A 5 ml amount of 0.9% saline is delivered onto the sample assembly. The time to absorb this liquid (strike-through time) is measured automatically by the Lister testing equipment and displayed. Subsequently, a new 5 ply blotter assembly is quickly placed underneath the nonwoven sample within 20 seconds, and the 5 ml delivery of saline is repeated. In total, the 5 ml delivery of liquid is performed 5 times on the selected nonwoven sample, and each strike-through time is, recorded. The sample is weighed again after the sequence of 5 tests. For a given code of nonwoven fabric, the 5-sequence test is repeated three times, and the 15 results are averaged to provide the strike-through time of the material.

The various tables of the present disclosure also provide data pertaining to a Runoff test. The Runoff test can be performed to ascertain the wettability of a nonwoven material in laboratory conditions (23° C. and 50% relative humidity). A 203 mm long and 152 mm wide sample of the selected nonwoven fabric is placed on a coform absorbent material. The coform material is a fibrous web which includes woodpulp and meltblown polypropylene fibers, and is capable of soaking up and containing many types of liquids. A suitable coform material is a 7 ounce coform material, which is available from Kimberly-Clark Nonwoven Fabrics, a business having offices located at 1111 Henry Street, Neenah, Wis., U.S.A. The coform absorbent material includes a non-absorbent film backing, has a basis weight of approximately 160 g/m$^2$, and measures 203 mm long and 133 mm wide. The coform is placed on the sample assembly with the film side facing the assembly. The nonwoven sample is placed on the coform such that the nonwoven sample overhangs the coform material by a overhang of 25 mm located along one of the shorter side edges. This sample assembly, with the overhang side placed at a relatively lower position, is then placed on a 45 degree inclined tray. 50 ml of 0.85% saline at 23° C. is delivered through a funnel placed 10 mm above the nonwoven. The funnel should deliver 100 ml of this liquid in 15±1.5 sec. The point of liquid delivery should be 76 mm from the bottom edge of the coform absorbent. After the delivery, the liquid that is not absorbed is collected at the bottom in a container and weighed. This will be the Runoff amount in grams. At least three replications on three samples are done for each code and the results reported as an average with standard deviation.

In addition, the various tables of the present disclosure provide data pertaining to crystallinity determined by X-ray diffraction, where the fiber materials were examined by using an X-ray diffractometer equipped with a two dimensional (2-D) position sensitive detector. A suitable X-ray diffractometer can be provided by a D-MAX RAPID system, which is available from Rigaku Corp., a business having offices located in The Woodlands, Tex., U.S.A. The measurements were executed employing a transmission geometry and Cu Kα radiation (λ=1.5405 Angstrom). The 2-D scattering images were azimuthally averaged in order to reduce the statistical error. After corrections for background scattering, geometry effects and absorption, the results were plotted with X-ray intensity on the y-axis) and scattering angle on the x-axis.

To determine the crystallinity index (CI), which is proportional to the absolute degree of crystallinity, one can employ the following procedure. The scattering curves are obtained from substantially non-crystalline fibers that contain only the non-crystalline phases of the fiber polymer. The scattering curves from the non-crystalline fibers are typically characterized with only broad maxima, and these curves represent the scattering from the non-crystalline phases (non-crystalline curve). After appropriate scaling, the appropriate non-crystalline curve can be operatively fitted under a total curve provided by fibers that have a crystalline component. The at least partially crystalline fibers produce diffraction curves that include sharp crystalline peaks generated from any crystalline phases that are present in the fiber polymer. The broad-maxima, curve (representing only the non-crystalline phases) is operatively "subtracted" from the total curve (representing a combination of crystalline and non-crystalline phases) to obtain a scattering curve which represents the scattering produced by only the crystalline-phases (the crystalline curve). Next the areas under the total curve and the crystalline curve are computed, and their ratio can be employed to determine a crystallinity index (CI) or a percent crystallinity. For example, the crystallinity index can be determined by employing the following formula:

$$CI = \frac{\int I_c(\theta)d\theta}{\int I_t(\theta)d\theta}$$

where:

θ is the diffraction angle;

$I_c(\theta)$ is the plotted, crystalline intensity-curve that represents the scattering intensities of the crystalline phases of the selected fiber polymer; and $I_c(\theta)$ is the plotted, total intensity-curve that represents the scattering intensities from a combination of the crystalline and non-crystalline phases of the selected fiber polymer.

It should be readily appreciated that modifications and variations to the present invention may be practiced by those of ordinary skill in the art, without departing from the spirit and scope of the present invention, which is more particularly set forth in the appended claims. It should also be understood that the aspects and features of the various configurations may be interchanged, both in whole or in part. Furthermore, those of ordinary skill in the art should appreciate that the foregoing description is by way of example only, and is not intended to add limitations beyond those set forth in the appended claims.

The invention claimed is:

1. A method of making thermoplastic polymer fibers, the method comprising: a) providing a thermoplastic polymer material that exhibits a slow crystallization rate; b) forming a plurality of molten polymer fibers from said thermoplastic polymer material; c) subjecting said molten polymer fibers immediately upon extrusion to anneal-quenching at an anneal-quench temperature that is at least 10° C. greater than the glass transition temperature (Tg) of said thermoplastic polymer material but less than a melting temperature thereof, and which approximates a prime temperature at which can achieve an amount of crystallinity in the thermoplastic polymer material of about 45% or greater as determined by differential scanning calorimetry (DSC).

2. The method according to claim 1, further comprises subjecting immediately the anneal-quenched polymer fibers to a fiber-draw at a draw temperature which is not more than 30° C. either higher or lower than said prime-temperature.

3. The method according to claim 2, wherein said fiber-draw temperature approximates said prime temperature.

4. The method according to claim 1, wherein said anneal-quenching is by means of a gas or air that has been heated to the anneal-quench temperature.

5. The method according to claim 1, wherein said thermoplastic polymer material exhibits a crystallization half-time value which is not less than about 300 sec, as determined by differential scanning calorimetry.

6. The method according to claim 1, wherein the anneal-quench temperature is not more than either 30° C. higher or lower than the prime-temperature.

7. The method according to claim 2, wherein the anneal-quenched polymer fiber material is subjected to a fiber-draw which provides a fiber draw down ratio of about 3000 or less.

8. The method according to claim 2, further includes depositing the anneal-quenched polymer fibers on an operative forming surface to produce a nonwoven fabric; and moving the forming surface at a surface speed of not more than about 1500 msec.

9. The method according to claim 2, wherein said the anneal-quenched polymer fibers is subject to a pneumatic fiber-draw.

10. The method according to claim 2, wherein the fiber-draw temperature is provided by an application of heated gas during the fiber-draw.

11. The method according to claim 2, wherein said anneal-quenched polymer fibers have a fiber size of not more than a maximum of about 30 μm.

12. The method according to claim 1, wherein the thermoplastic polymer material includes a base material that includes: a) a blend of polylactic acid polymers; b) a blend of polylactic acid copolymers; or c) a combination of a) and b).

13. The method according to claim 12, wherein said base material includes at least about 95 wt % of polylactic acid polymer.

14. The method according to claim 12, wherein the base material has been provided by admixing a base polymer with an operative amount of a plasticizer.

15. The method according to claim 14, wherein the amount of plasticizer is not more than about 10% by weight.

16. The method according to claim 12, wherein the base material has been provided by admixing the base polymer with an operative amount of a nucleating agent.

17. The method according to claim 16, wherein the amount of nucleating agent is up to about 5 wt %.

18. A method of forming a fiberous web, the method comprising: a) providing a thermoplastic polymer material from a melt b) forming said thermoplastic polymer material into a plurality of molten fiber material; and c) subjecting said polymer fiber material immediately upon extrusion to an anneal-quenching that is conducted before or during a solidification of the polymer fiber material from its molten state, wherein the polymer fiber material are subjected to an anneal-quench temperature that is at least 10° C. greater than the glass transition temperature (Tg) of said thermoplastic polymer material, up to a maximum of about 125° C.

19. The method according to claim 18, wherein said anneal-quench temperature is either not more than 30° C. higher or lower than a prime-temperature.

20. The method according to claim 18, further comprises subjecting said anneal-quenched polymer fiber material to a fiber draw-down ratio of about 3000 or less; and depositing a plurality of fibers on a moving forming surface to form a fibrous web.

* * * * *